US007181402B2

(12) United States Patent
Jax et al.

(10) Patent No.: US 7,181,402 B2
(45) Date of Patent: Feb. 20, 2007

(54) METHOD AND APPARATUS FOR SYNTHETIC WIDENING OF THE BANDWIDTH OF VOICE SIGNALS

(75) Inventors: Peter Jax, Aachen (DE); Juergen Schnitzler, Bochum (DE)

(73) Assignee: Infineon Technologies AG, Munich (DE)

( * ) Notice: Subject to any disclaimer, the term of this patent is extended or adjusted under 35 U.S.C. 154(b) by 927 days.

(21) Appl. No.: 10/111,522

(22) PCT Filed: Aug. 7, 2001

(86) PCT No.: PCT/EP01/09125

§ 371 (c)(1),
(2), (4) Date: Jul. 22, 2002

(87) PCT Pub. No.: WO02/17303

PCT Pub. Date: Feb. 28, 2002

(65) Prior Publication Data

US 2003/0050786 A1 Mar. 13, 2003

(30) Foreign Application Priority Data

Aug. 24, 2000 (DE) ..... 100 41 512

(51) Int. Cl.
*G10L 19/00* (2006.01)
*G10L 21/00* (2006.01)
*G10L 19/12* (2006.01)

(52) U.S. Cl. ..... 704/500; 704/223; 704/219

(58) Field of Classification Search ..... 704/219, 704/200.1, 220, 223, 256, 500
See application file for complete search history.

(56) References Cited

U.S. PATENT DOCUMENTS

| | | | | |
|---|---|---|---|---|
| 5,455,888 | A | 10/1995 | Iyengar et al. | 395/212 |
| 5,978,759 | A * | 11/1999 | Tsushima et al. | 704/223 |
| 6,675,144 | B1 * | 1/2004 | Tucker et al. | 704/219 |
| 6,691,083 | B1 * | 2/2004 | Breen | 704/220 |

OTHER PUBLICATIONS

Epps et al. A New Technique for Wideband Enhancement of Coded Narrowband Speech, 1999, IEEE Workshop on Speech Coding Proceedings, pp. 174-176.*

(Continued)

*Primary Examiner*—Richemond Dorvil
*Assistant Examiner*—Thomas E. Shortledge
(74) *Attorney, Agent, or Firm*—Maginot, Moore & Beck

(57) ABSTRACT

The invention provides a method and an apparatus for synthetic widening of the bandwidth of voice signals. This is done by providing a narrowband voice signal at a predetermined sampling rate; carrying out analysis filtering on the sampled voice signal using filter coefficients, which are estimated from the sampled voice signal, for envelope widening; carrying out residual signal widening on the analysis-filtered voice signal; and carrying out synthesis filtering on the residual-signal-widened voice signal in order to produce a broader band voice signal. The analysis filtering is carried out using identical filter coefficients to those used for the synthesis filtering.

17 Claims, 8 Drawing Sheets

OTHER PUBLICATIONS

Hiroshi Yasukawa, Restoration of Wide Band Signal from Telephone Speech Using Linear Prediction Residual Error Filtering, Oct. 6, 1996, Fourth International Conference on Spoken Language, vol. 2, pp. 901-904.□□.*

Endom et al. Bandwidth Expansion of Speech Based on Vector Quantization of the MEL Frequency Cepstral Coefficients, 1999, IEEE Workshop on Speech Coding Proceedings, pp. 171-173. □□□□.*

Ming Chen et al. Statistical Recovery of Wideband Speech from Narrowband Speech, Oct. 1994, IEEE Transactions on Speech and Audio Processing, vol. 2, pp. 544-548.*

Niklas Enbom et al., *Bandwidth Expansion of Speech Based on Vector Quantization of the MEL Frequency Cepstral Coefficients*, IEEE, 1999, pp. 171-173.

Peter Jax et al., *Wideband Extension of Telephone Speech Using a Hidden Markov Model*, IEEE, 2000, pp. 133-135.

* cited by examiner

Entry No. 1 ("high")

Entry No. 2 ("flat")

Entry No. 3 ("low")
Probability
0.06
0.05
0.04
0.03
0.02
0.01
0
40
60
80
Zero crossing rate [%]

METHOD AND APPARATUS FOR SYNTHETIC WIDENING OF THE BANDWIDTH OF VOICE SIGNALS

The present invention relates to a method and an apparatus for synthetic widening of the bandwidth of voice signals.

Voice signals cover a wide frequency range which extends approximately from the fundamental voice frequency, which is around approximately 80 to 160 Hz depending on the speed, up to frequencies above 10 kHz. During spoken communication via certain transmission media, for example the telephone, only a restricted part of the frequency range is, in fact, transmitted for reasons of bandwidth efficiency, with sentence comprehension of approximately 98% being ensured.

On the basis of the minimum bandwidth from 300 Hz to 3400 Hz specified for the telephone system, a voice signal can be roughly subdivided into three frequency ranges, and each of these ranges is responsible for specific voice characteristics and for subjective sensitivity:

- Low frequencies below about 300 Hz are produced mainly during voiced speech sections such as vocalizations. In this case, this frequency range contains tonal components, that is to say, in particular, the fundamental voice frequency ($f_p$) and possibly a number of harmonics, depending on the voice characteristic.
- The low frequencies are of critical importance for subjective sensitivity to the volume and dynamic range of a voice signal. The fundamental voice frequency can, in contrast, be perceived by a human listener on the basis of the psycho acoustic characteristic of the virtual tone level sensitivity from the harmonic structure in higher frequency ranges, even in the absence of the low frequencies.
- Medium frequencies in the range from 300 to 3400 Hz are also present in the voice signal during speech activity. Their time-variant spectral coloring by means of a number of formats and the time and spectral fine structure characterize the respectively spoken sound/phoneme. In this way, the medium frequencies transport the majority of the information that is relevant for comprehension of what is being spoken.
- High frequency components above about 3.4 kHz are produced predominantly during unvoiced sounds; these are particularly strong in the case of sharp sounds such as /s/ or /f/. Explosive sounds such as /k/ or /t/ also have a broad spectrum with strong high-frequency components. In this upper frequency range, the signal correspondingly has a character which is more noise-like than tonal.
- The structure of the formants in this range is relatively time-invariant, but differs for different speakers.
- The high frequency components are important for naturalness, clarity and presence of a voice signal—without these components the speech appears to be dull. Furthermore, these upper frequencies make it easier to distinguish between fricatives and consonants, and thus ensure that the speech is more easily understood.

Both the range of high frequencies and the range of low frequencies contain a number of speaker-specific characteristics, thus making it easier for a listener to identify the speaker. However, this statement must be considered in relative form to the extent that people generally become used to someone's "telephone voice" and can identify quite well despite the bandwidth restriction.

The aim of a voice communications system is always to transmit a voice signal with the best possible quality via a channel with a restricted bandwidth. The voice quality is in this case a subjective variable with a large number of components, the most important of which for a communications system is undoubtedly comprehensibility. The transmission bandwidth for analog telephones was defined as a compromise between bandwidth and speech comprehensibility: without any interference, sentence comprehensibility is approximately 98%. However, syllable comprehensibility is restricted to a considerably lower identification rate.

With modern digital transmission technology, we are moving into an area of very high speech comprehensibility and further aspects of voice quality are becoming more important, in particular those of a purely subjective nature such as naturalness, volume and dynamic range. If the mean opinion score (MOS) is used as an overall measure of subjective speech quality, then the influence of bandwidth on hearing sensitivity can be determined by hearing tests. FIG. 10 summarizes the results of such investigations for telephone handsets.

As can be seen, a considerable improvement in the subjective assessment of a voice signal can be achieved both by widening the telephone bandwidth in the high frequency direction (above 3.4 kHz) and in the direction of low frequencies (below 300 Hz). The best results are achieved when the widening is carried out in a balanced manner upward and downward; increasing the bandwidth with a range from 50 Hz to 7 kHz results in an improvement of 1.4 MOS points in comparison to telephone speech.

In the sense of subjective quality improvement, a bandwidth which is greater than the conventional telephone bandwidth is thus desirable for voice communications systems.

One possible approach is to modify the transmission and either to use a greater bit rate, or to use coding methods to achieve a broader transmitted bandwidth. However, this approach is complex.

Synthetic widening of the bandwidth of voice signals without transmitting any additional secondary information has so far been given only a very small amount of space in the literature in comparison to other digital voice signal processing functions. In principle, the published methods differ in terms of whether widening is intended to be achieved in the correction of high or low frequencies. Furthermore, the various algorithms apply major emphasis to different extents to a reconstruction of the rough spectral structure and/or to time and spectral fine structures.

The initial attempts to widen bandwidth were carried out by the BBC as early as 1971, with the aim of being able to assess so-called phone-ins to radio or television programs (M. G. Croll, "Sound Quality Improvement of Broadcast Telephone Calls", BBC Research Report RD1972/26, British Broadcasting Corporation, 1972). For widening in the downward direction, it was proposed that low frequency components be generated by means of a non linear rectifier, and that they then be added to the original signal after being filtered using a bandpass filter with a bandwidth from 80 Hz to 300 Hz.

A more far-reaching proposal to add individual sinusoidal tones at the pitch frequency and at its first harmonic leads to unbalanced overall sound with the band-limited voice signal, even though the root mean square value of the voice components between 300 Hz and 1 kHz was used to determine the amplitude of these sinusoidal tones (P. J. Patrick, "Enhancement of Bandlimited Speech Signals", Dissertation, Loughborough University of Technology, 1983).

In order to produce high frequency components, it has been proposed for the output signal from a noise generator to be modulated with the power of a subband (2.4–3.4 kHz) of the original signal, and be added to the original signal, after bandpass filtering with a bandwidth from 3.4 to 7.6 kHz.

A further approach, by Patrick, is based on analysis of the input signal by means of windowing and FFT. The band between 300 Hz and 3.4 kHz is copied into the band from 3.4 to 6.5 kHz and is scaled as a function of the power of the original signal in the band from 2.4 to 3.4 kHz and of the quotient of the powers in the ranges from 2.4 to 3.4 kHz.

A further method is motivated by the observation that, for one speaker, the higher formants change very scarcely at all in frequency and width over time. A nonlinearity is thus initially used to produce a stimulus, which is used as an input signal for a fixed filter for forming a formant. The output signal from the filter is added to the original signal, but only during voiced sounds. A system for bandwidth widening based on statistical methods is described in Y. M. Cheng, D. O'Shaugnessy, P. Mermelstein, "Statistical Recovery of Wideband Speech from Narrowband Speech". IEEE Transactions on Speech and Audio Processing, Volume 2, No. 4, October 1994. The signal source (that is to say the speech generation process) is treated as a set of mutually independent subsources, which are each band-limited, but of which, in the case of a narrowband signal, only a restricted number contribute to the signal and can thus be observed. An estimate for the parameters of those sources which cannot be observed directly can now be calculated on the basis of trained a priori knowledge, and these can then be used to reconstruct (the broadband) overall signal.

One option which can be implemented with little effort for linking digital-analog conversion to an increase in the bandwidth is to design the anti-aliasing low-pass filter that follows the digital/analog conversion such that the attenuation is slowly decreased by up to one and a half times the Nyquist frequency to a value of 20 dB, with a steeper transition to higher attenuations not being carried out until that level is reached (M. Dietrich, "Performance and Implementation of a Robust ADPCM Algorithm for Wideband Speech Coding with 64 kBit/s", Proc. International Zürich Seminar Digital Communications, 1984). Using a sampling frequency of 16 kHz, this measure produces mirror frequencies, in the range from 8 to 12 kHz, which give the impression of a wider bandwidth.

More recently, a number of methods have been presented, in which the widening of the spectral envelope and the widening of the fine structure are carried out separately from one another (H. Carl, "Untersuchung verschiedener Methoden der Sprachcodierung und eine Anwendung zur Bandbreitenvergrößerung von Schmalband-Sprachsignalen", [Investigation into various methods for speech coding, and an application to widening of the bandwidth of narrowband voice signals] Dissertation, Ruhr-University Bochum, 1994). In this case, a frame-by-frame LPC analysis of the input signal is carried out first of all, with the voice signal being filtered using the LPC inverse filter. The resultant residual signal has the spectral envelope removed from it, in the ideal case, by the "Whitening effect" of the LPC, and now contains only information relating to the fine structure of the signal.

The advantage of splitting the input signal into a description of the spectral coarse structure and a residual signal is that it is now possible to develop and to optimize the two algorithm elements for widening the components independently of one another.

The object of the algorithm element for widening the residual signal is to produce a broadband stimulus signal for the downstream filter, which signal firstly once again has a flat spectrum, but secondly also has a harmonic structure that matches the pitch frequency of the voice.

While similar approaches are often chosen for residual signal widening, the ways used to add the spectral envelope have diverged from one another.

Some of the methods are based on the assumption that there is an approximately linear relationship between the parameters of the vocal tract when described in narrowband form and when described in broadband form. The parameters obtained from LPC analysis are in this case used in various representation forms, for example as Cepstral coefficients or coefficients for DFT analysis (for example H. Hermansky, C. Avendano, E. A. Wan, "Noise Reduction and Recovery of Missing Frequencies in Speech", Proceedings 15th Annual Speech Research Symposium, 1995).

The parameters are fed in parallel into a number of linear so-called Multiple Input Single Output (MISO) filters. The output from each individual MISO filter represents the estimate of one broadband parameter; this estimate thus depends on all the narrowband parameters. The coefficients of the MISO filters are optimized in a training phase before bandwidth widening, for example using a minimum mean squared error criterion. Once all the broadband parameters for the current signal frame have been estimated by their own MISO filters, they can be used, in appropriately converted form, as coefficients for the LPC synthesis filter.

A second approach makes use of the restricted number of sounds that occur in a voice signal. A code book with representatives of the envelope forms of typical voice sounds is trained and stored. A comparison is then carried out during the widening process to determine which of the stored envelope forms is the most similar to the current signal section. The filter coefficients which correspond to this most similar envelope form are used as coefficients for the LPC synthesis filter.

All the methods mentioned here can in principle be used for widening in the directions of both higher and lower frequencies; only the residual signal widening need be designed to ensure that an appropriate stimulus is generated in the corresponding bands of the residual signal.

Although the known algorithms also differ widely, they all nevertheless have similar characteristics, and are subject to similar problems, to a greater or lesser extent.

The aim of balanced interaction between the newly generated signal components and the narrowband original signal appears to be particularly problematic. Incorrect amplitudes in the new band ranges give the listener the impression of speech distortion, which may even appear as speech corruption if, for example, the output signal sounds as if it is spoken with a lisp.

The present invention is based on the object of providing a method and an apparatus for synthetic widening of the bandwidth of voice signals, which are able to use a conventionally transmitted voice signal which, for example, has only the telephone bandwidth, and with the knowledge of the mechanisms of voice production and perception, to produce a voice signal which subjectively has a wider bandwidth and hence also better speech quality than the original signal but for which there is no need to modify the transmission path, per se, for such a system.

The invention is based on the idea that identical filter coefficients are used for analysis filtering and for synthesis filtering.

The basic structure of the algorithm according to the invention for bandwidth widening requires, in contrast to the known method, only a single broadband code book, which is trained in advance.

One major advantage of this algorithm is that the transmission functions of the analysis and synthesis filters may be the exact inverse of one another. This makes it possible to guarantee the transparency of the system with regard to baseband, that is to say with regard to that frequency range in which components are already included in the narrowband input signal. All that is necessary to do this is to ensure that the residual signal widening does not modify the stimulus components in baseband. Non-ideal analysis filtering in the sense of optimum linear prediction has no effect on baseband provided the analysis filtering and synthesis filtering are exact inverses of one another.

With the previously normal use of different coefficient sets for analysis filtering and synthesis filtering, the output signal from the synthesis filter had to be adaptively matched to the narrowband input signal, in order to ensure that the two signals have the same power in baseband. This necessity for adaptive estimation and use of the correction factors required for this purpose is completely avoided by the subject matter of the invention. Artefacts and faults resulting from incorrect estimates of the correction factors can thus likewise be avoided.

According to one preferred development, the filter coefficients for the analysis filtering and for the synthesis filtering are determined by means of an algorithm from a code book which has been trained in advance. The aim in this case is to determine the respectively best matching code book entry for each section of the narrowband voice signal.

According to a further preferred development, the sampled narrowband voice signal is in the frequency range from 300 Hz to 3.4 kHz, and the broader band voice signal is in the frequency range from 50 Hz to 7 kHz. This corresponds to widening from the telephone bandwidth to broadband speech.

According to a further preferred development, the algorithm for determining the filter coefficients has the following steps:

setting up the code book using a hidden Markov model, with each code book entry having an associated state in the hidden Markov model and with a separate statistical model being trained for each state, describing predetermined features of the narrowband voice signal as a function of that state;

extracting the predetermined features from the narrowband voice signal to form a feature vector X(m) for a respective time period;

comparing the feature vector with the statistical models; and determining the filter coefficients on the basis of the comparison result.

The determined features may be any desired variables which can be calculated from the narrowband voice signal, for example Cepstral coefficients, frame energy, zero crossing rate, etc. The capability to freely choose the features to be extracted from the narrowband voice signal makes it possible to use different characteristics of the narrowband voice signal in a highly flexible manner for bandwidth widening. This allows reliable estimation of the frequency components to be widened.

Statistical modeling of the narrowband voice signal furthermore allows a statement to be made about the achievable widening quality during the bandwidth widening process, since it is possible to evaluate how well the characteristics of the narrowband voice signal match the respective statistical model.

According to a further preferred development, at least one of the following probabilities is taken into account in the comparison process: the observation probability $p(X(m)|S_i)$ of the occurrence of the feature vector subject to the precondition that the source for the sampled voice signal is in the respective state $S_i$;

the transition probability that the source for the sampled voice signal will change to that state from one time period to the next; and the state probability of the occurrence of the respective state.

According to a further preferred development, the code book entry $C_i$ for which the observation probability $p(X(m)|S_l)$ is a maximum is used in order to determine the filter coefficients.

According to a further preferred development the code book entry for which the overall probability $p(X(m),S_i)$ is a maximum is used in order to determine the filter coefficients.

According to a further preferred development, a direct estimate of the spectral envelope is produced by averaging, weighted with the a posteriori probability $p(S_l|X(m)$, of all the code book entries, in order to determine the filter coefficients.

According to a further preferred development the observation probability is represented by a Gaussian mixed model.

According to a further preferred development, the bandwidth widening is deactivated in predetermined voice sections. This is expedient wherever faulty bandwidth widening can be expected from the start. This makes it possible to prevent the quality of the narrowband voice signal being made worse, rather than being improved, for example by artefacts.

The invention will be described in more detail in the following text using exemplary embodiments and with reference to the drawings, in which.

In the figures, identical reference symbols denote the same or functionally identical elements.

Figure 1:
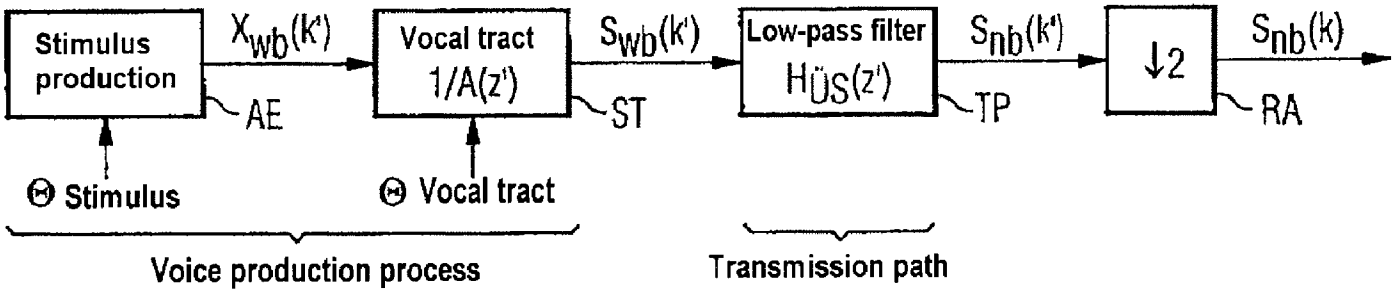
FIG. 1 shows a simple autoregressive model of the process of speech production, as well as the transmission path.

The technical boundary conditions for bandwidth widening will be explained first of all, which firstly govern the characteristics of the input signal and secondly define the path of the output signal as far as the signal receiver, that is to say the human ear.

That part which is located upstream of the algorithm comprises the entire transmission path from the speaker to the receiving telephone, that is to say, in particular, the microphone, the analog/digital converter and the transmission path between the telephones that are involved.

The useful signal is generally slightly distorted in the microphone. Depending on the arrangement and position of the microphone relative to the speaker, the microphone signal contains not only the voice signal but also background noise, acoustic echoes, etc.

Before analog/digital conversion of the microphone signal, its upper cut-off frequency is limited by analog filtering to a maximum of half the sampling frequency—if the sampling frequency is $f_a$=8 kHz, the bandwidth of the digital signal is thus a maximum of 4 kHz. The distortion and interference added by the analog preprocessing at quantization are assumed to be negligible in this case.

When analyzing the characteristics of the transmission path, it is necessary to distinguish between two cases:

In the case of analog transmission, interference occurs in the form of noise, line echoes, crosstalk, etc. In addition, for multiplexed paths, the voice signal is generally band-limited to the standardized frequency range from 300 Hz to 3400 Hz.

If, in contrast, the signal is transmitted using digital techniques, then, in the ideal case, the transmission can be regarded as being transparent (for example in the ISDN network). However, if the signal is coded for transmission, for example for a mobile radio path, then both non-linear distortion and additive quantization noise may occur. Furthermore, transmission errors have a greater or lesser effect in this case.

Based on the described system characteristics, the following text assumes that the input signal has the following characteristics:

The voice signal is band limited. The transmitted bandwidth extends upward, at best, to a cut-off frequency of 4 kHz, but in general only up to about 3.4 kHz. The bandwidth cut-off at low frequencies depends on the transmission path and, in the worst case, may occur at about 300 Hz.

Depending on the position of the microphone relative to the speaker and on the acoustic situation at the transmission end, additive background interference of various types must be expected in the input signal.

The voice signal may be distorted to a greater or lesser extent. This distortion depends on the transmission path and may be of either a linear or a non-linear nature.

From the point of view of the input signal, widening in the direction of high frequencies is invariably worthwhile. In contrast, the input signal already contains low frequencies in some cases, and there is then no need to add to these artificially; otherwise, bandwidth widening is also worthwhile in this area. When designing the algorithm for bandwidth widening, possible distortion and interference should be taken into account, so that a robust solution can be achieved.

The output signal from the algorithm for bandwidth widening is essentially converted to analog form, then passes through a power amplifier and, finally, is supplied to an acoustic front end.

The digital/analog conversion may be assumed to be ideal, for the purposes of bandwidth widening. The subsequent analog power amplifier may add linear and non-linear distortion to the signal.

In conventional handsets and hands-free units, the loudspeaker is generally quite small, for visual and cost reasons. The acoustic power which can be emitted in the linear operating range of the loudspeaker is thus also low, while the risk of overdriving and of the non-linear distortion resulting from it is high. Furthermore, linear distortion occurs, the majority of which is also dependent on the acoustic environment. Particularly in the case of handsets, the transmission characteristic of the loudspeaker is highly dependent on the way in which the ear piece is held and is pressed against the ear.

Figure 11A:
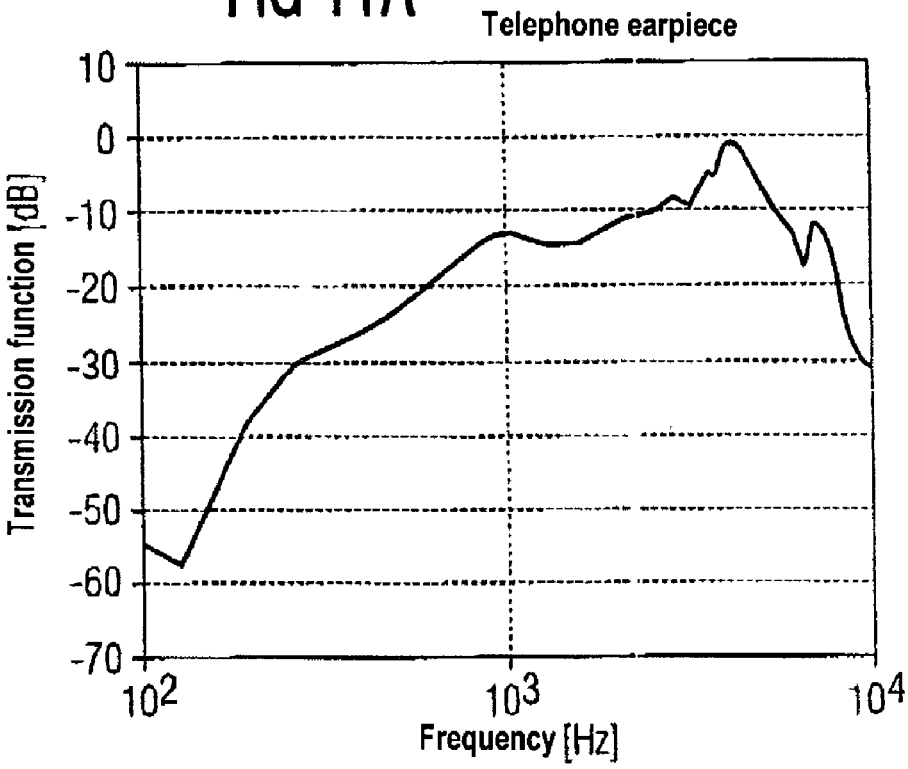
FIG. 11 shows typical transmission characteristics of two acoustic front ends.
Figure 11B:
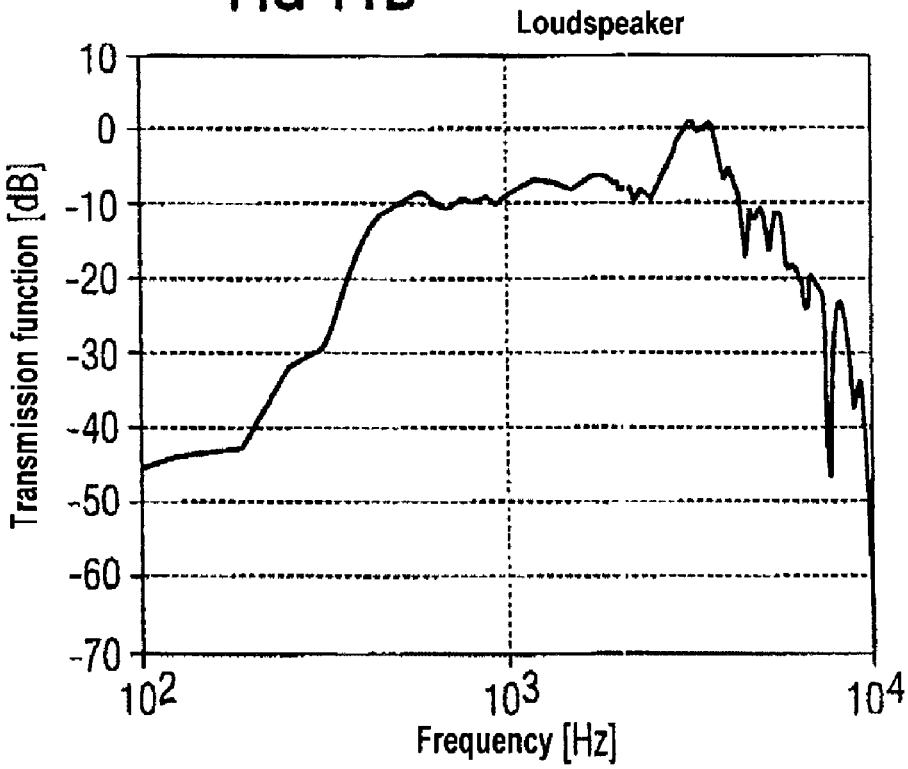

By way of example, FIG. 11 shows the typical frequency responses of the overall output transmission path (that is to say including digital/analog conversion, amplification and the loudspeaker) for a telephone ear piece and for the loudspeaker in a hands-free telephone. The individual components were not overdriven for these qualitative measurements; the results therefore do not include any non-linearities. The severe linear and non-linear distortion which is produced by the acoustic front end restricts the possible working range for bandwidth widening:

Widening in the downward direction appears to be scarcely worthwhile, since conventional front ends cannot transmit these low frequencies in any case. High-power, low-frequency voice components thus cause a deterioration in the acoustic signal, since they lead to increased overdriving of the system, so that the speech sounds "rattly".

In the case of handsets, the transmission bandwidth of the front end in the low frequency direction is also limited by "acoustic leakage" which results from suboptimum sealing of the ear piece capsule by the telephone listener. The extent of this leakage depends predominantly on the contact pressure of the ear piece and, within certain limits, can be controlled by the subscriber.

In contrast to this, it invariably appears to be possible to widen voice signals in the direction of high frequencies. However, the characteristics of the loudspeaker should also be taken into account in this case, since there is no point in trying to widen the bandwidth up to, for example, 8 kHz when the signal is already attenuated by over 20 dB at 7 kHz.

The restrictions described above apply, of course, only to systems with the described characteristics. As soon as acoustic front ends with improved characteristics are used, the options for synthetic bandwidth widening also increase—in particular those which add low frequency components.

The primary aim of increasing the bandwidth of voice signals is to achieve a better subjectively perceived speech quality by widening the bandwidth. The better speech quality results in a corresponding benefit for the user of the telephone. A further aim is to improve speech comprehensibility.

The development of an algorithm for bandwidth widening should therefore always take account of the following aspects:

The subjective quality of a voice signal must never be made worse by bandwidth widening. A number of aspect elements are relevant in this context.

The baseband, that is to say the frequency range which is already included in the input signal, should, as far as possible, not be modified or distorted in comparison to the input signal, since the input signal always provides the best possible signal quality in this band.

The synthetically added voice components must match the signal components contained in the narrowband input signal. Thus, in comparison to a corresponding broadband voice signal, there must be no severe signal distortion produced in these frequency ranges, either. Changes to the voice material which make it harder to identify the speaker should also be regarded as distortion in this context.

Finally, as far as possible, the output signal must not contain any synthetically ringing artefacts.

Robustness is a further criterion, in which case the term robustness is in this case intended to mean that the algorithm for bandwidth widening always provides good results for input signals with varying characteristics. In particular, the method should be speaker-independent and should work for various languages. Furthermore, it must be assumed that the input signal contains additive interference, or has been distorted, for example, by a coding or quantization.

If the characteristics of the input signal differ excessively from the specified predetermined characteristics, the algorithm should deactivate bandwidth widening so that the quality of the output signal is never made excessively worse.

Bandwidth widening is not feasible in all situations or for all signal types. The capabilities are restricted firstly by the characteristic of the physical environment and secondly by the characteristics of the signal source, that is to say the speech production process for voice signals.

Bandwidth widening is subject to a major limitation by the characteristics of the acoustic front end. The transmission characteristics of typical loudspeakers in commercially available telephones make it virtually impossible to emit low frequencies down to the fundamental voice frequency range.

Frequency components can be extrapolated only provided they can be predicted on the basis of a model of the signal source. The restriction on the handling of voice signals means that additional signal components which have been lost by low-pass filtering or bandpass filtering of the broadband original signal (for example acoustic effects such as Hall or high-frequency background noise) generally cannot be reconstructed.

The following invention is used in the following text:

Signals are often defined by the two sampling rates $f_a$=8 kHz and $f_{a'}$=16 kHz. In order to make it easier to distinguish between them, all time and frequency indexes which relate to the higher sampling rate $f_{a'}$ are provided with a prime character. For example, a signal x(k) would be sampled at 8 kHz, while the signal y(k') is sampled at 16 kHz.

In the case of signals for which the bandwidth is unambiguous, this is identified by a subscript nb for narrowband or wb for broadband. It should be noted that narrowband signals (marked by nb) can also be combined with the high sampling rate $f_{a'}$.

The chosen starting point for the described embodiment of the invention is the algorithm by Carl (H. Carl "Untersuchung verschiedener Methoden der Sprachcodierung und eine Anwendung zur Bandbreitenvergrößerung von Schmalband-Sprachsignalen", [Investigation into various methods for speech coding, and an application to bandwidth widening of narrowband voice signals', Dissertation, Ruhr-University Bochum, 1994).

The production of new voice signal components will be described first of all. All the methods described here are based on a simple autoregressive (AR) model of the speech production process. In this model, the signal source is composed of only two time-variant subsystems, as is shown in FIG. 1.

The stimulus signal $x_{wb}(k')$ which results from the first stimulus production part AE (corresponding to the lungs and the vocal chords) is, on the basis of the model principles, spectrally flat and has a noise-like characteristic for unvoiced sounds, while it has a harmonic pitch structure for voiced sounds.

The second part of the model models the vocal tract or voice tract ST (mouth and pharynx area) as a purely recursive filter 1/A(z'). This filter provides the stimulus signal $x_{wb}(k')$ with its coarse spectral structure.

The time-variant voice signal $s_{wb}(k')$ is produced by varying the parameters $\theta_{stimulus}$ and $\theta_{vocal\ tract}$. The transmission path is modeled by a simple time-invariant low-pass or bandpass filter TP with the transfer function $H_{US}(z')$. The resultant narrowband voice signal, as is produced by the algorithm for bandwidth widening, is $s_{nb}(k')$, which is generally produced after reduction of the sampling frequency RA by a factor of 2 to a sampling rate of $f_a$=8 kHz.

The first step in the bandwidth widening process is to segment the input signal $s_{nb}(k)$ into frames each having a length of K samples (for example, K=160). All the subsequent steps and algorithm elements are invariably carried out on a frame basis. A signal frame with an increased sampling frequency $f_{a'}$=16 kHz has twice the length K'=2K.

At this point, motivated by the simple model of the speech production process, the input signal $s_{nb}(k)$ is then split into the two components, stimulus and spectral envelope form. These two components can then be processed independently of one another, although the precise way in which the algorithm elements that are used for this purpose operate need not initially be defined at this point—they will be described in detail later.

The input signal can be split in various ways. Since the chosen variants have different influences on the transparency of the system in baseband, they will first of all be compared with one another, in detail, in the following text.

Figure 2:
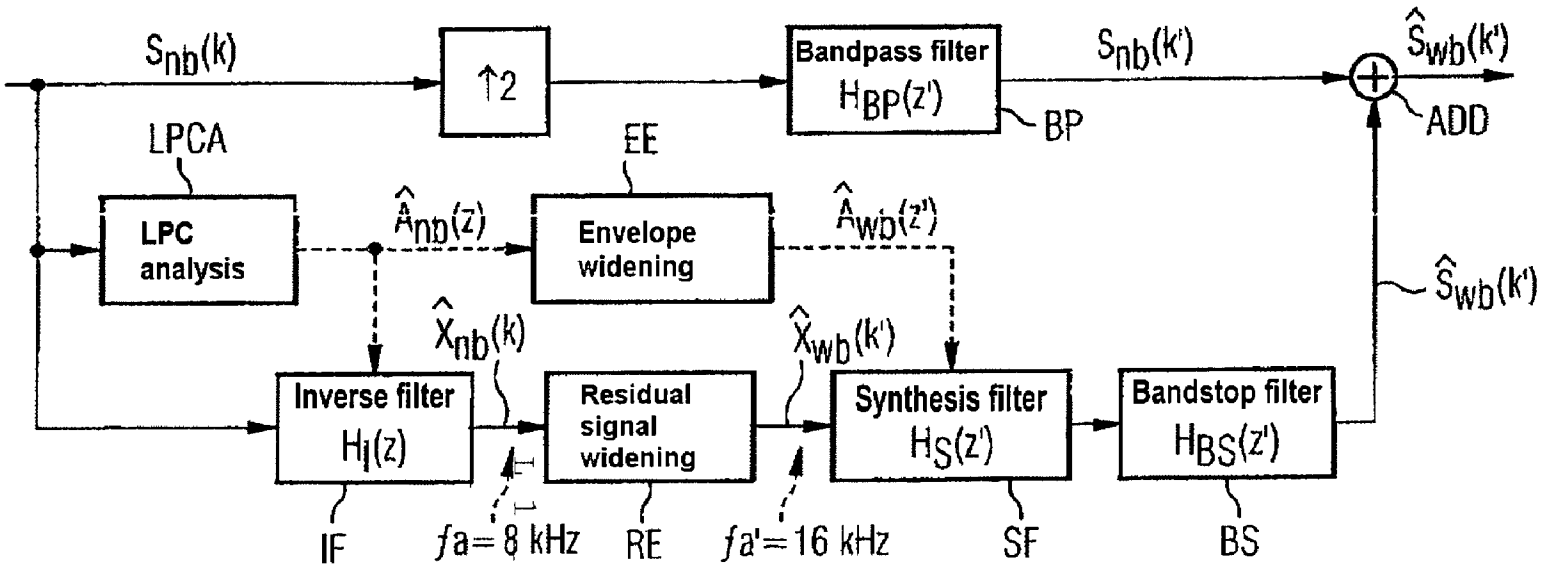
FIG. 2 shows the technical principle of bandwidth widening according to Carl.

The principle of the procedure is thus for the input signal to be made spectrally flatter, that is to say "whiter" by means of an adaptive filter $H_I(z)$. Once the estimate $\hat{x}_{nb}(k')$, calculated in this way, of the narrowband stimulus signal has been spectrally widened (residual signal widening), it is used as an input signal for a spectral weighting filter $H_S(z')$, which is now used to impress on the residual signal $\hat{x}_{wb}(k')$ which is now in broadband form, the spectral envelope form, which is in the meantime likewise being widened, that is to say converted to a broadband form, as is illustrated in FIG. 2.

One requirement for algorithms for bandwidth widening is that signal components which already exist in the input signal must not be distorted or modified by the system, apart from a signal delay t, that is to say:

$$\hat{S}_{wb}(z')H_{\hat{u}s}(z')=S_{nb}(z')(z')^{-2}.$$

This aim can be achieved, approximately, in various ways, and these will be explained in the following text. By way of example, the widening of the spectral envelope is assumed to be carried out by means of a code book method.

First of all, the process of mixing with the input signal will be described.

The first known variant as shown in FIG. 2 provides for the narrowband input signal $s_{nb}(k)$ in this case first of all to be subjected to LPC analysis (Linear Predictive Coding, see, for example, J. D. Markel, A. H. Gray, "Linear Prediction of Speech", Springer Verlag, 1976), in the device LPCA.

During the LPC analysis, the filter coefficients $\tilde{a}_{nb}(k)$ of a nonrecursive prediction filter $\tilde{A}(z)$ are optimized for a speech frame $s_{nb}^{(m)}(k)$ in such a way that the power of the output signal $x_{nb}(k)=s_{nb}^{(m)}(k)*\tilde{a}_{nb}(k)$ from this prediction filter is a minimum:

$$\epsilon\{x_{nb}(k))^2\}\rightarrow\min.$$

This minimizing of the power results in the frequency spectrum of the residual signal $x_{nb}(k)$ becoming flatter or "whiter" than the frequency spectrum of the original signal $s_{nb}(k)$. The information relating to the spectral envelope of the input signal is included in the filter coefficients $\tilde{a}_{nb}(k)$. The Levinson-Durbin algorithm, for example, can be used to calculate the optimized filter coefficients $\tilde{a}_{nb}(k)$.

The filter coefficients $\tilde{A}_{nb}(z)$ determined by the LPC analysis LPCA are used as parameters for an inverse filter IR $$H_I(z)=\tilde{A}_{nb}(z),$$

into which the narrowband voice signal is inserted—the output signal $\hat{x}_{nb}(k)$ from this filter is then the sought spectrally flat estimate of the stimulus signal and is in narrowband form, that is to say it is at the low sampling rate $f_a$=8 kHz. Once, firstly, the residual signal has now been spectrally widened in the residual signal widening block RE and, secondly, the LPC coefficients have been spectrally widened in the envelope widening block EE, they can be used as an input signal $\hat{x}_{wb}(k')$ or parameter $\hat{A}_{wb}(z')$ J. D. Markel, A. H. Gray "Linear Prediction of Speech", Springer Verlang, 1976 for the subsequent synthesis filter SF $$H_S(z') = \frac{1}{\hat{A}_{wb}(z')}$$

Since, as a result of the described procedure using LPC analysis, the estimate $\hat{x}_{nb}(k)$ of the band-limited stimulus signal satisfies the requirement for spectral flatness very well, the newly synthesized band regions can be formed well with this first variant; in the case of a white residual signal, the coarse spectral structures in these regions depend primarily on the predetermined requirements for envelope widening.

However, the method has a more negative effect on baseband. Since the inverse filter $H_I(z)$ and the subsequent synthesis filter $H_S(z')$ use (depending on the envelope widening) filter coefficients which are not ideally the inverse of one another, the envelope form in the baseband region is generally distorted to a greater or lesser extent. If, for example, the envelope widening is carried out by means of a code book, then the output signal $\tilde{s}_{wb}(k')$ of the system in baseband corresponds to a variant of the input signal $s_{nb}(k)$ in which the envelope information has been vector-quantized.

Since this distortion of the baseband signal, which in some cases is significant, cannot be accepted, the various frequency components in the output signal must be dealt with separately, and must be mixed at the output from the system.

The signal whose bandwidth has been widened in the manner described above has all those frequency components which are within baseband removed from it by a bandstop filter BS whose transfer function is $H_{BS}(z')$. The bandstop filter BS must therefore have a frequency response which is matched to the characteristic of the transmission channel, and hence to the input signal, that is to say, as far as possible, its transfer function should be:

$$H_{BS}(z')=1-H_{US}(z')$$

The narrowband input signal is first of all interpolated by the insertion of zero values and, possibly, by low-pass filtering to produce the increased sampling rate at the output from the system. A bandpass filter BP whose transfer function is $H_{BP}(z')$ is then once again used to remove all those signal components which are not in baseband, that is to say:

$$H_{BP}(z')=H_{US}(z').$$

The filter that is used for the interpolation process can generally be omitted since the task of anti-aliasing filtering can be carried out by the bandpass filter BP.

The two signal elements $s_{nb}(k')$ and $\tilde{s}_{nb}(k')$ are mixed at the output of the system by means of a simple addition device ADD. In order that no errors whatsoever occur during this addition process, it is important that the signal elements that are involved are correctly matched to one another.

In order to avoid major phase errors, it is necessary for the delay times of the two parallel signal paths to be carefully matched to one another. This can be achieved by means of a simple delay element, which is inserted into that one of the two paths which produces the shorter algorithmic delay. The delay time produced by this delay element must be set such that the overall delay times of both signal paths are exactly the same.

Furthermore, it is critically important to the quality of the output signal $\hat{s}_{wb}(k')$ that the power levels of the two signal elements $s_{nb}(k')$ and $\tilde{s}_{wb}(k')$ are matched.

The bandwidth widening process can influence the power level of the signal at various points; attention must therefore be paid to the ratio of the power levels in baseband and in the synthesized regions. This task, which initially sounds simple, can be split into two problem elements:

The residual signal widening block must operate in such a way that, despite the increase in the sampling rate, the power level in baseband in the output signal corresponds exactly to the power level of the input signal.

Inverse filtering and synthesis filtering using filters which are not exact inverses of one another generally result in a change to the power level of the signal, depending on the frequency responses of the two filters. This situation will be explained with reference to FIG. 3.

Figure 3A:
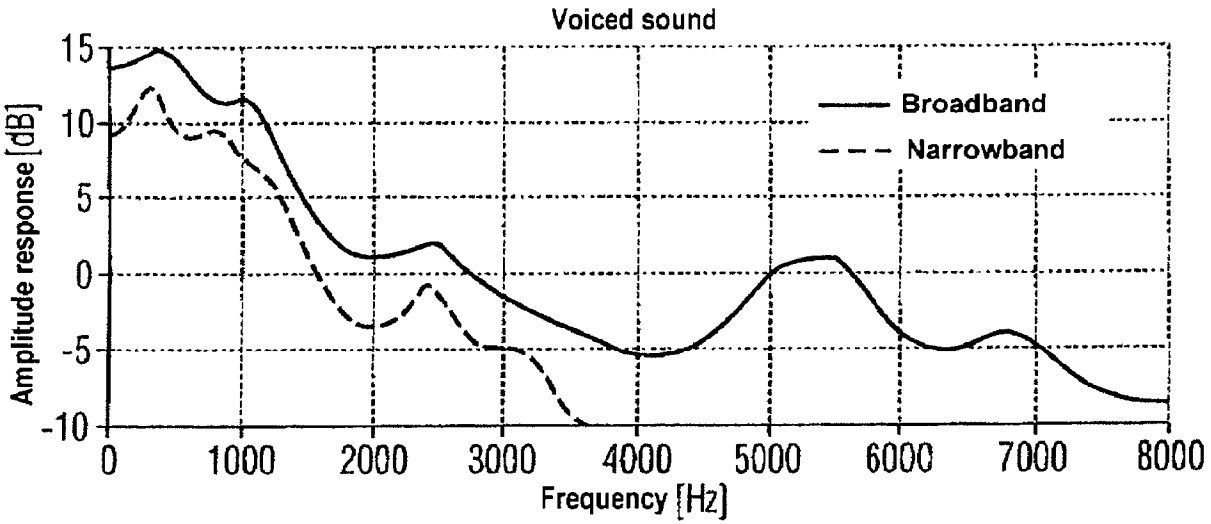
FIG. 3 shows the frequency responses of the inverse filter and of the synthesis filter for two different sounds.
Figure 3B:
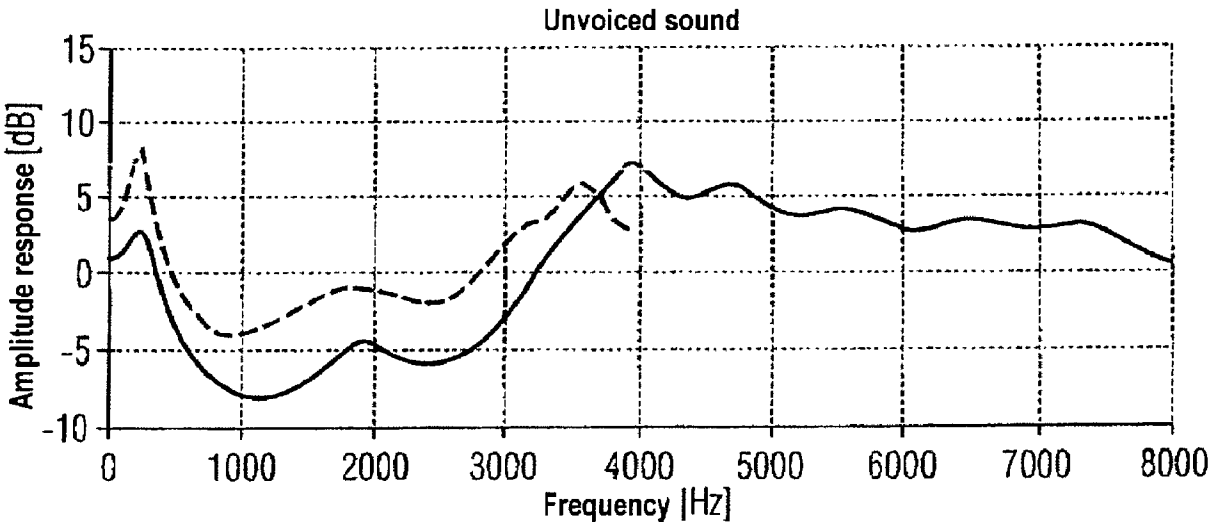

FIG. 3 shows the frequency responses of the associated inverse filter $H_I(z)$ and of the synthesis filter $H_S(z')$, in each case within one co-ordinate system, for two different sounds (voiced and unvoiced). Depending on their task, the filters are designed such that they change only the envelope form. The impulse responses h(k) are thus normalized such that the first filter coefficient in each case has the value h(0)=1. This situation is expressed in the frequency range such that the frequency response $H(e^{j\Omega})$ of each filter is shifted vertically, so that the integral over the entire frequency range corresponds to a fixed value, as can easily be understood on the basis of the rule for Fourier transformation:

$$h(0) = \frac{1}{2\pi}\int_{-\pi}^{\pi} H(e^{j\Omega})d\Omega \stackrel{\square}{=} 1.$$

If the frequency responses of a pair of associated inverse and synthesis filters are now considered, then it can be seen that there is a difference between a broadband filter and a narrowband filter, in baseband. The magnitude of this difference depends on the frequency responses of the two filters, and cannot easily be predicted. The difference means that there is a change in the power level in baseband when such a pair of filters are linked: with the illustrated frequency response examples, the power level of the voiced sound in baseband would be increased, while it would be reduced for the unvoiced sound. If the original baseband signal $s_{nb}(k)$ is now mixed, without any further measure, with the widened signals produced in this way, the matching between the two components will be mixed up (by the same mechanism).

To counteract this, the signal $\tilde{s}_{wb}(k')$ whose bandwidth has been widened must be multiplied by a correction factor $\zeta$ which compensates for this power modification once again. Such a correction factor depends on the form of the frequency responses of a pair of filters and can thus not be predetermined in a fixed manner. In particular, the LPC analysis that is used here results in the difficulty that the frequency response of the inverse filter $H_I(z)$ is not known a priori.

However, the power level of the baseband components of the signal $\tilde{s}_{wb}(k')$ whose bandwidth has been widened can be compared with the power level of the interpolated input signal $s_{nb}(k')$. For the signal components to match correctly, this ratio must be unity:

$$\sum_{\kappa'=0}^{K'-1} (\tilde{s}_{wb}(\kappa') * h_{us}(\kappa'))^2 \stackrel{\square}{=} \sum_{\kappa'=0}^{K'-1} (s_{nb}(\kappa'))^2,$$

so that the correction factor $\zeta$ can be determined from the square root of the reciprocal of this power ratio:

$$\varsigma^2 = \frac{\sum_{\kappa'=0}^{K'-1} (s_{nb}(\kappa'))^2}{\sum_{\kappa'=0}^{K'-1} (\tilde{s}_{wb}(\kappa') * h_{us}(\kappa')^2}.$$

The use of this rule for determining a correction factor is dependent on additional filtering of the signal $\tilde{s}_{wb}(k')$, whose bandwidth has been widened, using a bandpass filter whose transfer function corresponds to that of the transmission path $H_{US}(z')$.

Figure 4:
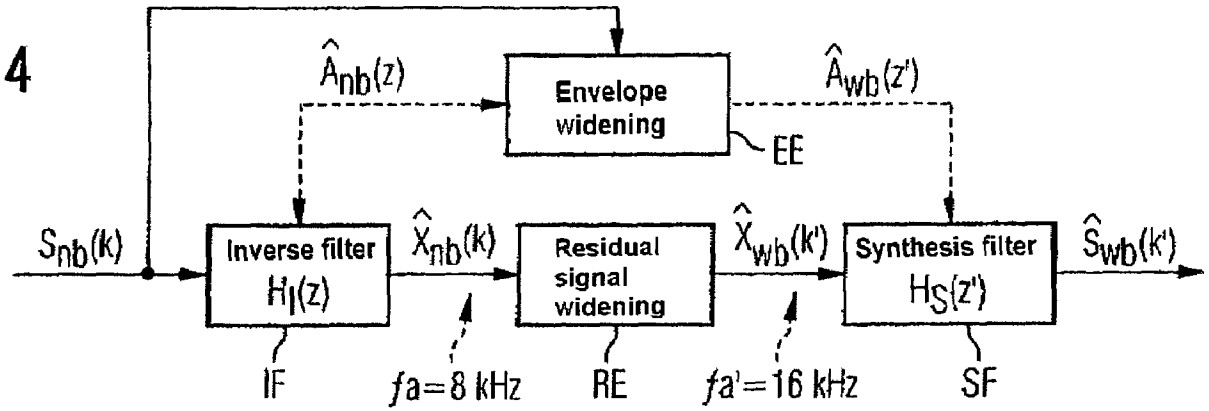
FIG. 4 shows a first embodiment of the bandwidth widening as claimed in the present invention.

A simplification in comparison to the variant described above can be achieved by dispensing with the initial LPC analysis that is required there. FIG. 4 illustrates the block diagram of the exemplary embodiment of the invention that results from this.

The parameters for the first LPC inverse filter IF with the transfer function $H_I(z)$ are now no longer governed by LPC analysis of the input signal $s_{nb}(k)$ but—in the same way as the parameters for the synthesis filter $H_S(z')$—by the envelope widening EE. The two parameter sets $\hat{A}_{nb}(z)$ and $\hat{A}_{wb}(z)$ can now be matched to one another in this block, that is to say the quality of the inverse filtering is reduced somewhat at the expense of a better match between the frequency responses of the inverse filter and synthesis filter in baseband. One possible implementation may be, for example, the use of code books which are produced in parallel but separately, for the parameters of the two filters. Only entries with an identical index i are then ever read at one time from both code books, which have been matched to one another in a corresponding manner during training.

The purpose of matching the parameters of the filter pair $H_I(z)$ and $H_S(z')$ is to achieve greater transparency in baseband. Since the inverse filter and the synthesis filter are now approximately the inverse of one another in baseband, errors which occur during the inverse filtering IF are cancelled out once again by the subsequent synthesis filter SF. However, as mentioned, even in this structure, the filter pairs are not perfect inverses of one another; slight differences cannot be avoided, resulting from different sampling rates at which the filters operate, and as a result of the filter orders, which therefore necessarily differ from one another. This means that the voice signal $\hat{s}_{nb}(k')$ in baseband is distorted in comparison to the first variant.

A further error source is due to the fact that the residual signal $\hat{x}_{nb}(k)$ of the inverse filter $H_I(z)$ is no longer white in all frequency ranges. This either requires ingenious residual signal widening, or leads to errors in the newly generated frequency ranges.

A number of savings can be quoted as an advantage of this embodiment:

First of all, there is no need for the bandstop and bandpass filters $H_{BS}(z')$ and $H_{BP}(z')$, which were necessary in the first variant, in order to ensure transparency in baseband. The computation power that they require is also saved, as well as the signal delay produced by the filters.

Furthermore, the matching of the signal power levels is considerably less complex. Errors in the signal power level in this case effect only the total power level of the output signal and would be apparent to a listener only in comparison with the narrowband or broadband original signal.

Furthermore, in this variant, the inverse filter and synthesis filter are operated at different sampling rates. This means that, as in the case of the first variant as well, there is a need for a correction factor $\zeta$ since, otherwise, the signal power would vary as a function of the sound being spoken at any given time. However, it is considerably easier to determine such a factor in this case, since the frequency responses of the filter pairs are already known in advance. The correction factor $\zeta_1$ to be expected for the i-th filter pair $\hat{A}_{nb}^{(i)}(z)$ and $\hat{A}_{wb}^{(i)}(z')$ of a code book can thus even be calculated in advance and, for example, stored in the code book.

Figure 5:
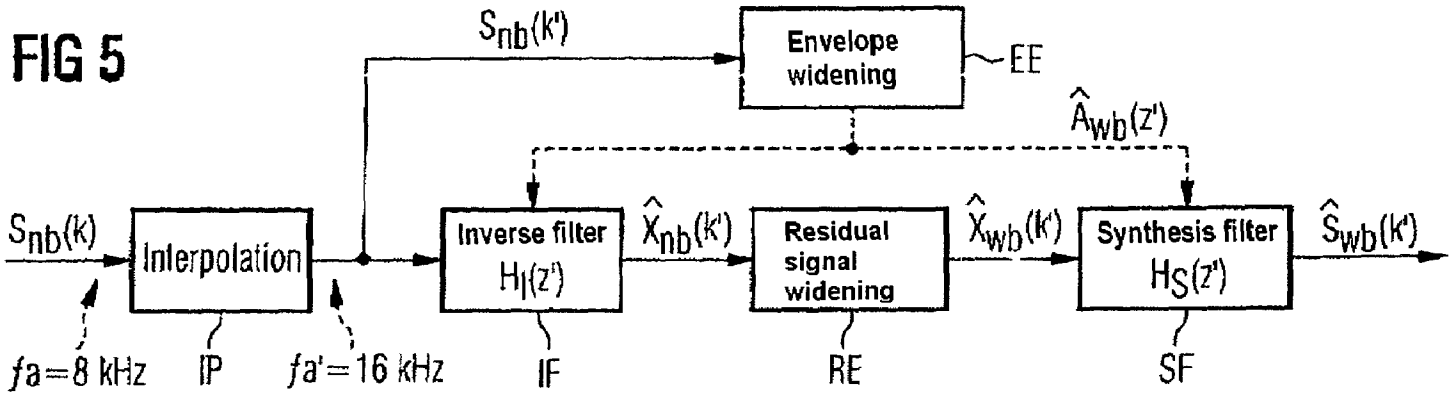
FIG. 5 shows a further embodiment of the bandwidth widening as claimed in the present invention.

A further alternative embodiment of the invention is sketched in FIG. 5. In comparison to the first embodiment, there is admittedly scarcely any change in the computation power required here, but the modifications have a considerable influence on the quality of the output signal.

In contrast to the first embodiment, both the inverse filter $H_I(z')$ and the synthesis filter $H_S(z')$ are operated with the same sampling rate of $f_{a'}$=16 kHz in the structure proposed here. This allows the filter coefficients to be set such that the two filters are exact inverses of one another, that is to say:

$$H_s(z') = \frac{1}{H_I(z')}.$$

This behavior means firstly that the required characteristic of transparency in baseband can be ensured considerably better, since all the errors which are produced by inverse filtering in baseband are now counteracted once again in the synthesis filter. On the other hand, this measure means that a less complex solution can be chosen when developing the algorithm for envelope widening.

One significant advantage of the use of filters which are exact inverses of one another is, furthermore, that there is now no longer any need whatsoever for power matching by means of correction factors $\zeta$.

With regard to the quality of the newly synthesized frequency components, the same minor restrictions exist as for the first embodiment. The fact that the residual signal $\hat{x}_{nb}(k')$ of the inverse filter now exists with a high sampling rate must be taken into account for residual signal widening, but does not require any fundamental changes to this algorithm element. However, it must be remembered that the residual signal $\hat{x}_{nb}(k')$ contains only stimulus components in the baseband region.

The second embodiment assumes that, although the input voice signal $s_{nb}(k')$ is in band-limited form, it has an increased sampling rate of $f_a'$=16 kHz. Thus, in the case of a digital transmission path, an interpolation stage must generally be inserted before the bandwidth widening. Depending on the band limiting of the voice signal, the interpolation low-pass filter is, however, subject to comparatively minor requirements. The voice signal generally already has a low upper cut-off frequency (for example of 3.4 kHz), so that the transition region of the filter may be quite broad (its width may be 1.2 kHz in the example). Furthermore, aliasing effects can generally be tolerated to a small extent, so that they are negligible in comparison to the effects produced by the bandwidth widening process. Nevertheless, a short interpolation filter always results in the disadvantage of a signal delay.

Various measures will now be explained which are intended to improve the subjectively perceived quality of the signal $\hat{s}_{wb}(k')$ whose bandwidth has been widened. These simple modifications to the algorithms are largely independent of the specific embodiment of the algorithm elements for residual signal and envelope widening.

For some transitions between sounds, clicking noises may be perceived at the boundaries between two frames. These artefacts result from the abrupt switching between two envelope forms at different levels. The effect is thus particularly dominant when a code book with a small size I is used, since the sound transitions can be modeled less finely the greater the differences between the individual entries in the code book.

One method which is often used against errors (for example in speech coding) is to subdivide each speech frame (for example with a duration of 10 ms) into a number of subframes (with a duration, for example, of 2.5 or 5 ms) and to calculate the filter coefficients $\hat{A}_{nb}(z)$ or $\hat{A}_{wb}(z')$ which are used for these subframes by interpolation or averaging of the filter coefficients determined for the adjacent frames. For averaging, it is advantageous to change the filter coefficients to an LSF representation, since the stability of the resultant filters can be guaranteed for interpolation using this description form. Interpolation of the filter parameters results in the advantage that the envelope forms which can be achieved overall are far more numerous than the coarse subdivision which would otherwise be predetermined in a fixed manner by the size I of the code book.

The basis of the approach for averaging filter coefficients is the observation that the human vocal tract has a certain amount of inertia, that is to say it can change to a new spoken sound only within a finitely short time.

A number of options have been investigated for linking the output values, calculated for the subframes, to one another:

- The most obvious solution is to use mutually adjacent subframes. One speech frame is in this case broken down into subframes which do not overlap, are processed separately from one another, and are finally linked to one another once again. In this variant, the filter states of the inverse filter $H_I(z)$ and synthesis filter $H_S(z')$ must each be passed on to the next subframe.
- If the individual subframes are allowed to partially overlap one another, then an overlap add technique must be used when combining the subframes to form the output signal. The output signal calculated for each subframe is thus initially weighted with a window function (for example Hamming), and is then added, in the overlapping areas, to the corresponding areas of the adjacent frames. In this variant, the filter states must not be passed on from one subframe to the next, since the states do not relate to the same, continued signal.

Furthermore, investigations have been carried out relating to the optimum influencing length of the interpolation. In the process, the number of adjacent speech frames from which a new filter parameter set was in each case calculated was varied in the range from 2 (that is to say averaging exclusively from the direct neighbours) to 10.

The greater the chosen size of the interpolation window, the greater is the reduction in artefacts and errors which are produced by incorrect association during the envelope widening process. On the other hand, the quality of the output signal is made worse when a number of rapid changes in the sound take place.

The number of adjacent frames used for the averaging process should thus be kept as small as possible.

The best results were found with a variant in which the original frame size K' is retained for the subframes, but each speech frame is subdivided into two subframes, which thus each overlap the two adjacent subframes by half the frame size K'/2. The calculation of the output signal $\hat{s}_{wb}(k')$ is then carried out using the overlap add method. This measure results in the clicking artefacts disappearing completely.

A filter $H_{PF}(z')$ may be connected downstream from the algorithm, as the final stage, for controlling the extent of bandwidth widening, and in the following text this is referred to as a post filter. Here, the post filter was always in the form of a low-pass filter.

- The upper cut-off frequency of the output signal $\hat{s}_{wb}(k')$ can be defined by a low-pass filter with steep flanks and a fixed cut-off frequency. A filter such as this with a cut-off frequency of 7 kHz has been found, by way of example, to be useful in order to reduce tonal artefacts which are produced from the high-power low voice frequencies during spectral convolution. In particular, high-frequency whistling at the Nyquist frequency $f_a/2$ which can result (depending on the method used for residual signal widening) from the DC component of the input signal $s_{nb}(k)$ is effectively suppressed.
- Artefacts and interference which are distributed over a wide range of the newly synthesized frequency components can be controlled effectively by means of a low-pass filter in which the attenuation increases only slowly as the frequencies rise.

Figure 6A:
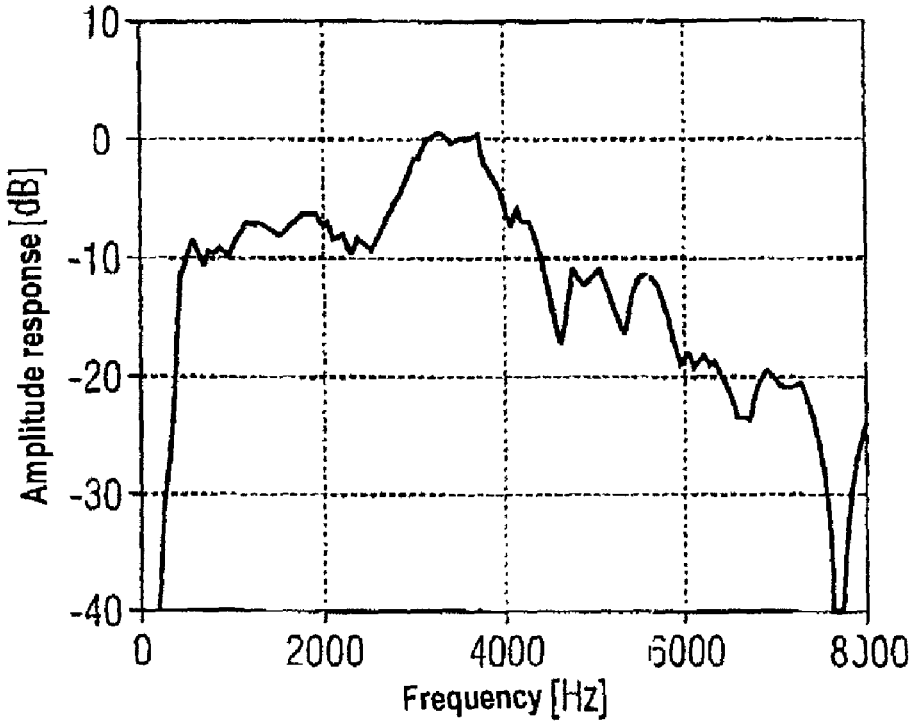
FIG. 6 shows a comparison of the frequency responses of an acoustic front end and of a post filter, as was used for hearing tests with relatively high-quality loudspeaker systems.
Figure 6B:
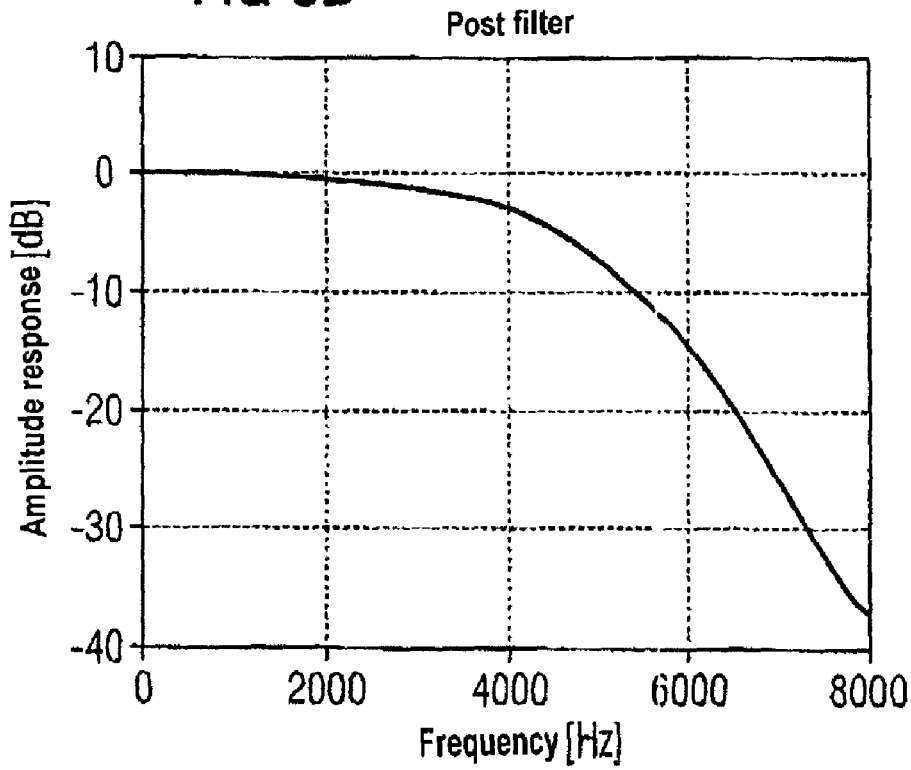

For example, it is possible to use a simple eighth-order FIR filter which produces an attenuation of 6 dB at 4.8 kHz and an attenuation of approximately 25 dB at 7 kHz, as is illustrated in FIG. 6.

Similar low-pass characteristics can also be observed in many acoustic front ends and therefore generally exist in any case in the implemented system, that is to say even without explicitly using a digital post filter.

The algorithm element for residual signal widening will be described next. The aim of residual signal widening is to determine the corresponding broadband stimulus from the estimate $\hat{x}_{nb}(k)$, which is in narrowband form, of the stimulus to the vocal tract. This estimate $\hat{x}_{wb}(k')$ of the stimulus signal in broadband form is then used as an input signal for the subsequent synthesis filter $H_S(z')$ On the basis of the fundamental model for speech production, specific characteristics can be assumed both for the input signal and for the output signal for residual signal widening.

The input signal $\hat{x}_{nb}(k)$ of the algorithm element for residual signal widening is produced by filtering the narrowband voice signal $s_{nb}(k)$ using the FIR filter $H_I(z)$, whose coefficients are predetermined by LPC analysis or by means of a code book search. This results in the residual signal having a flat, or approximately wide, spectral envelope.

Thus, if the current speech frame $s_{nb}^{(m)}(k)$ has a noise-like nature, then the residual signal frame $\hat{x}_{nb}^{(m)}(k)$ corresponds approximately to (band-limited) white noise; in the case of a voiced sound, the residual signal has a harmonic structure composed of sinusoidal tones at the fundamental voice frequency $f_p$ and at integer multiples of it, in which case, although these individual tones each have approximately the same amplitude, the spectral envelope is thus once again flat.

The output signal $\hat{x}_{wb}(k')$ from the residual signal widening is used as a stimulus signal to the subsequent synthesis filter $H_S(z')$. Thus, in principle, it must have the same characteristics of spectral flatness as the input signal $\hat{x}_{nb}(k)$ to the algorithm element, but over the entire broadband frequency range. In the same way, in the case of voiced sounds, there should ideally be a harmonic structure corresponding to the fundamental voice frequency $f_p$.

One important requirement for the algorithm for bandwidth widening is transparency in baseband. In order to make it possible to achieve this aim, it is necessary to ensure that the stimulus components are not modified in baseband. This also includes the power density of the stimulus signal not being changed. This is important in order to ensure that the output signal $\hat{s}_{wb}(k')$ from the bandwidth widening process is at the same power level as the input signal $s_{nb}(k)$ in baseband—in particular when the newly synthesized signal components at the output of the overall system are combined with an interpolated version $s_{nb}(k')$ of the input signal.

There are a number of fundamental options for residual signal widening. The simplest option for widening the residual signal is spectral convolution, in which a zero value is in each case inserted for every alternative sample of the narrowband residual signal $\hat{x}_{nb}(k)$. A further method is spectral shifting, with the low and the high half of the frequency range of the broadband stimulus signal $\hat{x}_{wb}(k')$ being produced separately. In this case as well, spectral convolution is carried out first of all, and the broadband signal is then filtered, so that this signal element contains only low-frequency components. In a further branch, this signal is modulated and is then supplied to a high-pass filter, which has a lower cut-off frequency of, typically, 4 kHz. The modulation results in a shift from the initial convolution of the original signal components. Finally, the two signal elements are added.

A further alternative option for generating high-frequency stimulus components is based on the observation that, in voice signals, high-frequency components occur mainly during sharp hissing sounds and other unvoiced sounds. In a corresponding way, these high frequency regions generally have more of a noise-like nature than a tonal nature. With this approach, band-limited noise with a matched power density is thus added to the interpolated narrowband input signal $x_{nb}(k')$.

A further option for residual signal widening is to deliberately use non-linearity effects, by using a non-linear characteristic to distort the narrowband residual signal.

Furthermore, there are various methods for modifying the residual signal before and after the widening process, and hence for improving the characteristics of the output signal, such as post filters, separate processing of high-frequency and low-frequency stimulus components, whitening filters, long term prediction (LTP), and distinguishing between voiced and unvoiced sounds, etc.

The widening of the spectral envelope of the narrowband input signal is the actual core of the bandwidth widening process.

The chosen procedure is based on the observation that a voice signal contains only a limited number of typical sounds, with the corresponding spectral envelopes. In consequence, it appears to be sufficient to collect a sufficient number of such typical spectral envelopes in a code book in a training phase, and then to use this code book for the subsequent bandwidth widening process.

The code book, which is known per se, contains information about the form of the spectral envelopes as coefficients $\hat{A}(z')$ of a corresponding linear prediction filter. The code book entries can thus be used directly in the respective LPC inverse filter $H_r(z')=\hat{A}(z')$ or synthesis filter $H_S(z')=1/\hat{A}(z')$ The nature of the code books produced in this way thus corresponds to code books such as those used for gain-shape vector quantization in speech coding. The algorithms which can be used for training and for use of the code books are likewise similar; all that is necessary in the bandwidth widening process, in fact, is to take appropriate account of the involvement of both narrowband and broadband signals.

During the training process, the available training material is subdivided into a number of typical sounds (spectral envelope forms), from which the code book is then produced by storing representatives. The training is carried out once for representative speech samples and is therefore not subject to any particularly stringent restrictions in terms of computation or memory efficiency.

The procedure that is used for training is in principle the same as for the gain-shape vector quantization (see, for example, Y. Linde, A. Buzo, R. M. Gray, "An algorithm for Vector Quantizer Design", IEEE Transactions on Communications, Volume COM-28, No. 1, January 1980). The training material can be subdivided by means of a distance measure into a series of clusters, in each of which spectrally similar speech frames are combined from the training data. A cluster i is in this case described by the so-called Centroid $C_i$, which forms the center of gravity of all the speech frames which are associated with that respective cluster.

In some of the known algorithms for bandwidth widening, it is necessary to use a number of parallel code books, for example if the inverse filtering $H_I(z)$ and the synthesis filtering $H_S(z')$ are carried out using different sampling rates. In cases such as these, it is, of course, important to match the coefficient sets $\hat{A}_{nb}(z)$ and $\hat{A}_{wb}(z')$ that are used for the two filters to one another, that is to say a code book entry in the primary LPC code book—in broadband or narrowband form depending on the training—must describe the same sound as the corresponding entry in the second, so-called shadow, code book.

Where the following text refers to a or the code book, this generally refers to the totality including the primary code book and all associated shadow code books, except where a specific code book is being discussed explicitly. How many code books, and which code books, are actually used depends on the algorithmic structure of the bandwidth widening process.

One fundamental decision which must be made before the training process is to determine whether the narrowband version $s_{nb}(k)$ or the broadband variant $s_{wb}(k')$ of the training material will be used for training the primary code book. Methods that are known from the literature use exclusively the narrowband signal $s_{nb}(k)$ as the training material.

One major advantage of using the narrowband signal $s_{nb}(k)$ is that the characteristics of the signals are the same for training and for bandwidth widening. The training and bandwidth widening processes are thus very well matched to one another. If, on the other hand, the broadband training signal $s_{wb}(k')$ is used for producing the code book, then a problem arises in that only a narrowband signal is available during the subsequent code book search, and the conditions thus differ from those during training.

However, one advantage of using the broadband training signal $s_{wb}(k')$ for training is that this procedure is much more realistic for the actual intention of the training process, namely for finding representatives of broadband speech sounds that are as good as possible, and of storing them. If various code book entries which have been produced using a broadband voice signal during training are compared, then quite a large number of sound pairs can be observed for which the narrowband spectral envelopes are very similar to one another, while the representatives of the broadband envelopes always differ to a major extent. In the case of sounds such as these, problems can be expected when training using narrowband training material, since the similar sounds are combined in one code book entry, and the differences between the broadband envelopes thus become less apparent as a result of the averaging process.

Overall, the advantages of broadband training greatly outweigh those of narrowband training, so that the investigations which are explained in the following text are based on such training.

The size of the code book is a factor that has a major influence on the quality of the bandwidth widening. The larger the code book, the greater the number of typical speech sounds that can be stored. Furthermore, the individual spectral envelopes are represented more accurately. On the other hand, the complexity not only of the training process but also of the actual bandwidth widening process also grows, of course, with the number of entries. When defining the code book size, it is therefore necessary to reach a compromise between the algorithmic complexity and the signal quality of the output signal $\hat{s}_{wb}(k')$ that can be achieved in the best case (that is to say for an "optimum" search in the code book). The number of entries stored in the code book is identified by I.

A search by inverse filtering with all the entries of a narrowband code book, followed by a comparison of the residual signal power levels $E_x^{(I)}$ generally does not lead to satisfactory results. Thus, in addition to the form of the spectral envelopes, other characteristics of the narrowband input signal $s_{nb}(k)$ should also be evaluated in order to select the code book entry.

With the statistical approach (introduced in this embodiment) for carrying out searches in the code book, the weighting of the individual speech features with respect to one another is implicitly optimized during the training phase. In this case, there is no need whatsoever to compare envelope forms by means of inverse filtering.

Figure 7:
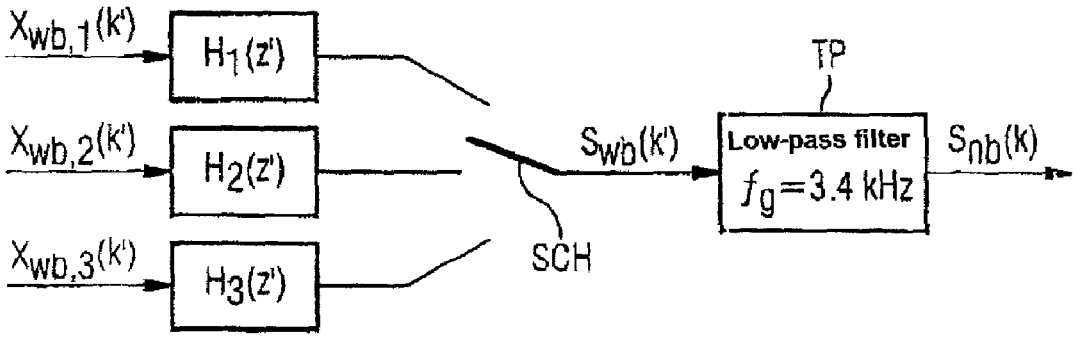
FIG. 7 shows a hidden Markov model of the speech production process for I=3 possible states.
Figure 10:
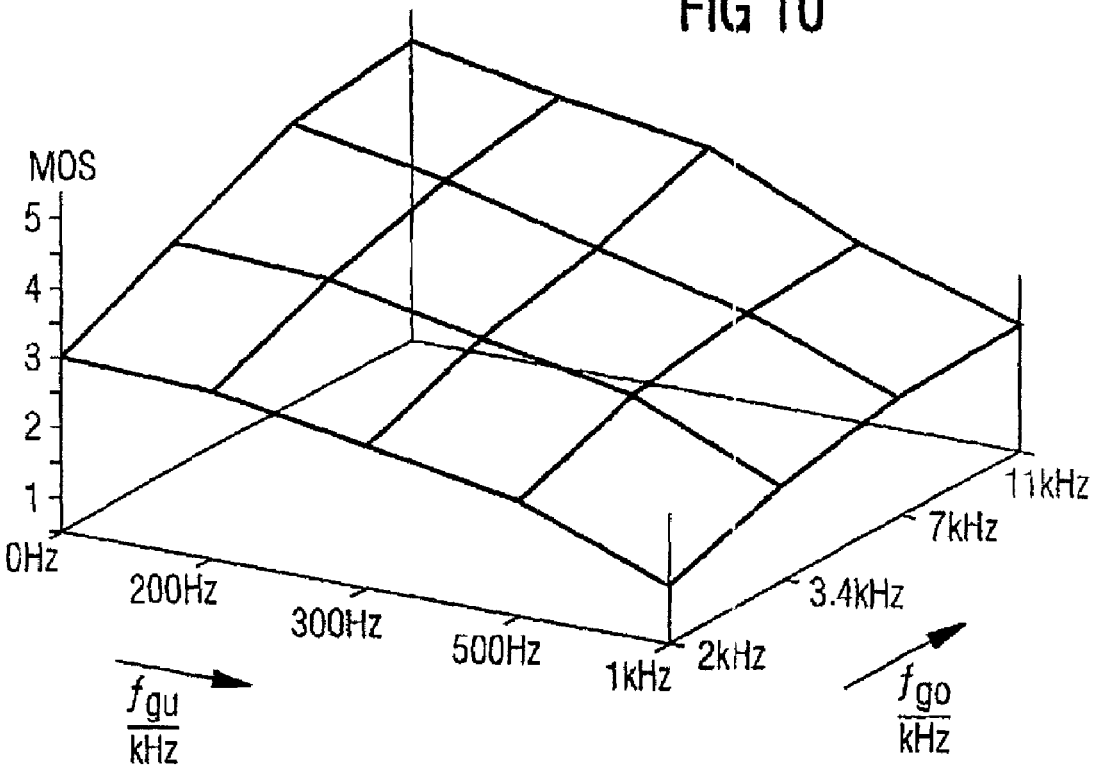
FIG. 10 shows an illustration relating to subjective assessment of voice signals with different bandwidths, with $f_{gu}$ representing the lower band limit and $f_{go}$ representing the upper band limit.

The statistical approach is based on a model, modified somewhat from those in FIG. 1, of the speech production process, as is sketched in FIG. 7. The signal source is now assumed to be in the form of a hidden-Markov process, that is to say it has a number of possible states, which are identified by the position of the switch SCH. The switch position only ever changes between two speech frames; one state of the source is thus linked in a fixed manner to each frame. The current state of the source is referred to as $S_l$ in the following text.

Specific characteristics of the stimulus signal $x_{wb}(k')$ and of the vocal tract, or of the spectral envelope form, are now linked to each state $S_i$ of the source. The possible states are defined such that each entry i in the broadband code book has its own associated state $S_i$. The typical form of the spectral envelopes is thus predetermined (by $H_I(z')=1\hat{A}_{wb}^{(i)}(z')$) just by the contents of the code book entry. Typical characteristics of the stimulus signal $x_{wb,i}(k')$ can likewise be found for each state. High-pass-like code book entries will in fact occur, for example, in conjunction with noise-like, unvoiced stimuli while, in contrast, voiced sounds are associated with tonal stimulus with low-pass-like envelope forms.

The object to be achieved by the code book search is now to determine the initially unknown position of the switch, that is to say the state $S_i$ of the source, for each frame of the input signal $s_{nb}(k)$. A large number of approaches have been developed for similar problems, for example for automatic voice recognition, although the objective in this case is generally to select from a set of stored models (for voice recognition, a separate hidden-Markov model is generally trained and stored for each unit (phoneme, word or the like) to be recognized) or state sequences that which best matches the input signal, while only a single model exists for bandwidth widening, and the aim is to maximize the number of correctly estimated states. Estimation of the state sequence is made more difficult by the fact that all the information about the (broadband) source signal $s_{wb}(k')$ is not available, due to the low-pass and bandpass filtering (transmission path).

The algorithm which is used to determine the most probable state sequence can be subdivided into a number of steps for each speech frame, and these steps will be explained in the following subsections.

1. First of all, a number of features are extracted from the narrowband signal.
2. Various a priori and/or a posteriori probabilities can be determined by means of a statistical model that has previously been trained for this purpose, and by means of the features obtained.
3. Finally, these probabilities can be used either to classify the speech frame or to calculate an estimate, which is not associated with discrete code book entries, of the spectral envelope form.

The features extracted from the narrowband voice signal $s_{nb}(k)$ are, in the end, the basis for determining the current source state $S_i$. The features should thus contain information which is correlated as well as possible with the form of the broadband spectral envelopes. In order to achieve a high level of robustness, the chosen features may, on the other hand, be related as little as possible to the speaker, language, changes in the way of speaking, background noise, distortion, etc. The choice of the correct features is a critical factor for the quality and robustness which can be achieved with the statistical search method.

The features calculated for the m-th speech frame $S_{nb}^{(m)}(k)$ of length K are combined to form the feature vector x(m), which represents the basis for the subsequent steps. A number of speech parameters which can be used are described briefly in the following text, by way of example. All the speech parameters are dependent on the frame index m—where the calculation of a parameter depends only on the contents of the current frame, the identification of the dependency on the frame index m is omitted in the following text, for the sake of simplicity.

One feature is the short-term power $E_n$.

The energy in a signal section is generally higher in voiced sections than in unvoiced sounds or pauses. The energy is in this case defined as:

$$E_n = \sum_{\kappa'=0}^{K-1} (s_{nb}(\kappa))^2.$$

This frame energy is, however, dependent not only on the sound currently being spoken but also on absolute level differences between different speech samples. In order to exclude this influence (which is undesirable for the bandwidth widening process) of the global playback level, the related frame power $$\tilde{E}_n(m) = \frac{E_n(m)}{E_{n,\max}}$$

must be related to the maximum frame power that occurs in the entire speech sample, which is composed of M frames:

$$E_{n,\max} = \max_{m=0}^{M-1} E_n(m)$$

$\tilde{E}_n(m)$ can thus assume values in the range from zero to unity.

A global maximum for the frame power can, of course, be calculated only if the entire speech sample is available in advance. Thus, in most cases, the maximum frame energy must be estimated adaptively. The estimated maximum frame power $\hat{E}_{n,max}(m)$ is then dependent on the frame index m and can be determined recursively, for example using the expression $$\hat{E}_{n,\max}(m) = \begin{cases} E_n(m) & \text{for} \quad E_n(m) \rangle \alpha \hat{E}_{n,\max}(m-1) \\ \alpha \hat{E}_{n,\max}(m-1) & \text{else} \end{cases}$$

The speed of the adaptation process can be controlled by the fixed factor $\alpha<1$.

Another feature is the gradient index $d_n$.

The gradient index (see J. Paulus "Codierung breitbandiger Sprachsignale bei niedriger Datenrate" [Coding of broadband voice signals at a low data rate]. Aachen lectures on digital information systems, Verlag der Augustinus Buchhandlung, Aachen, 1997) is a measure which evaluates the frequency of direction changes and the gradient on the signal. Since this signal has a considerably smooth profile during voiced sounds than during unvoiced sounds, the gradient index will also assume a lower value for voiced signals than for unvoiced signals.

The calculation of the gradient index is based on the gradient:

$$\Psi(k) = x_{nb}(k) - x_{nb}(k-1)$$

of the signal. In order to calculate the actual gradient index, the magnitudes of the gradients that occur at direction changes in the signal are added up, and are normalized using the RMS energy $\sqrt{E_n}$ of the frame:

$$d_n = \frac{\sum_{\kappa=1}^{K-1} \frac{1}{2}(\text{sign}(\Psi(\kappa)\Psi(\kappa-1)) + 1)|\Psi(\kappa)|}{\sqrt{E_n}}$$

The sign function evaluates the mathematical sign of its argument $$sign(x) = \begin{cases} 1; & x \geq 0 \\ -1; & x < 0 \end{cases}$$

A further feature is the zero crossing rate ZCR.

The zero crossing rate indicates how often the signal level crosses through the zero value, that is to say changes its mathematical sign, during one frame. In the case of noise-like signals, the zero crossing rate is higher than in the case of signals with highly tonal components. The value is normalized to the number of sample values in a frame, so that only values between zero and unity can occur.

$$ZCR = \frac{1}{K}\sum_{\kappa=0}^{K-1} |sign(s_{nb}(\kappa)) - sign(s_{nb}(\kappa-1))|$$

A further feature is Cepstral coefficients $c_p$.

Cepstral coefficients are frequently used as speech parameters, which provide a robust description of the smoothed spectral envelope of a signal, in voice recognition. The real-value Cepstral of the input signal $s_{nb}(k)$ is defined as the inverse Fourier transform of the magnitude spectrum, in logarithmic form, $$c_p = IDFT\{ln|DFT\{s_{nb}(k)\}|\}$$

While the zero Cepstral coefficient $c_0$ depends exclusively on the power level of the signal, the subsequent coefficients describe the form of the envelope.

In terms of complexity, it is advantageous for the calculation to be followed by LPC analysis by means of a Levinson-Durbin algorithm; the LPC coefficients can be converted to Cepstral coefficients by means of a recursive rule. It is sufficient to take account, for example, of the first eight coefficients for the desired coarse description of the envelope form of the narrowband input signal.

Further important features of voice signals include the rates of change of the parameters described above. Simple use of the difference between two successive parameters in time as an estimate of the derivative leads to very noisy and unreliable results, however. A method which is described in L. Rabiner, B. -H. Juang, "Fundamentals of Speech Recognition" Prentice Hall, 1993 and is based on an approximation to the actual time derivative of the parameter profile by using a polynomial, leads to a simple expression, which will be quoted here based on the example of the short-term power level $E_n(m)$ $$\frac{\partial}{\partial m}E_n(m) \approx \sum_{\lambda=-\Lambda}^{\Lambda} \lambda E_n(m+\lambda)$$

The constant ˆ makes it possible to determine the number of frames which should be taken into account for ˆ smoothing the derivative. A greater value for A produces a less noisy result, but it must be remembered that this necessitates an increased signal delay since, on the basis of the above expression, future frames are also included in the estimation of the derivative.

To achieve an acceptable compromise between the dimension of the feature vector and the classification results that are achieved, the composition of the feature vector can be chosen from the following components:

short-term power $E_n$ (with an adaptive normalization factor $E_{n,max}(m)$; $\alpha$=0.999), gradient index $d_n$, eight Cepstral coefficients $c_1$ to $c_8$, and derivatives of all ten of the above parameters with ˆ=3.

This therefore results in twenty speech parameters which are combined for each speech frame to form the feature vector X:

$$X = \left\{E_n, d_n, c_1, \ldots, c_8, \frac{\partial}{\partial m}E_n, \frac{\partial}{\partial m}d_n, \frac{\partial}{\partial m}c_1, \ldots\right\}$$

The dimension of the feature vector X is denoted by N in the following text (in this case: N=20).

With regard to the probabilities, it is necessary to distinguish between a number of different probabilities. In this context, the observation probability is intended to mean the probability of the feature vector X being observed subject to the precondition that the signal source is in the defined state $S_i$.

This probability $P(X|S_i)$ depends solely on the characteristics of the source. In particular, the distribution density function $p(X|S_i)$ depends on the definition of possible source states, that is to say in the case of bandwidth widening, on the spectral envelopes stored in the code book.

The observation probability cannot be calculated analytically with indefinite accuracy on the basis of the complex relationships in the speech production process, but must be estimated on the basis of information which has been collected in a training phase. It should be remembered that the distribution density function (VDF) is an N-dimensional function, owing to the dimension X. It is therefore necessary to find ways to model this VDF by means of models that are as simple as possible, but which are nevertheless sufficiently accurate.

The simplest option for modeling the VDF $p(X|S_i)$ is to use histograms. In this case, the value range of each element of the feature vector is subdivided into a fixed number of discrete steps (for example 100), and a table is used to store, for each step, the probability of the corresponding parameter being within the value interval represented by that step. A separate table must be produced for each state of the source.

It can easily be seen that, for feasibility reasons, this method does not have the capability to take account of covariances between the individual elements of the feature vector: if, by way of example, the value range of each parameter were to be subdivided very coarsely into only 10 steps, then a total of $10^{20}$ memory locations would be required to store a histogram that completely describes the 20-dimensional distribution density function!

Figures 8A, 8B, 8C:
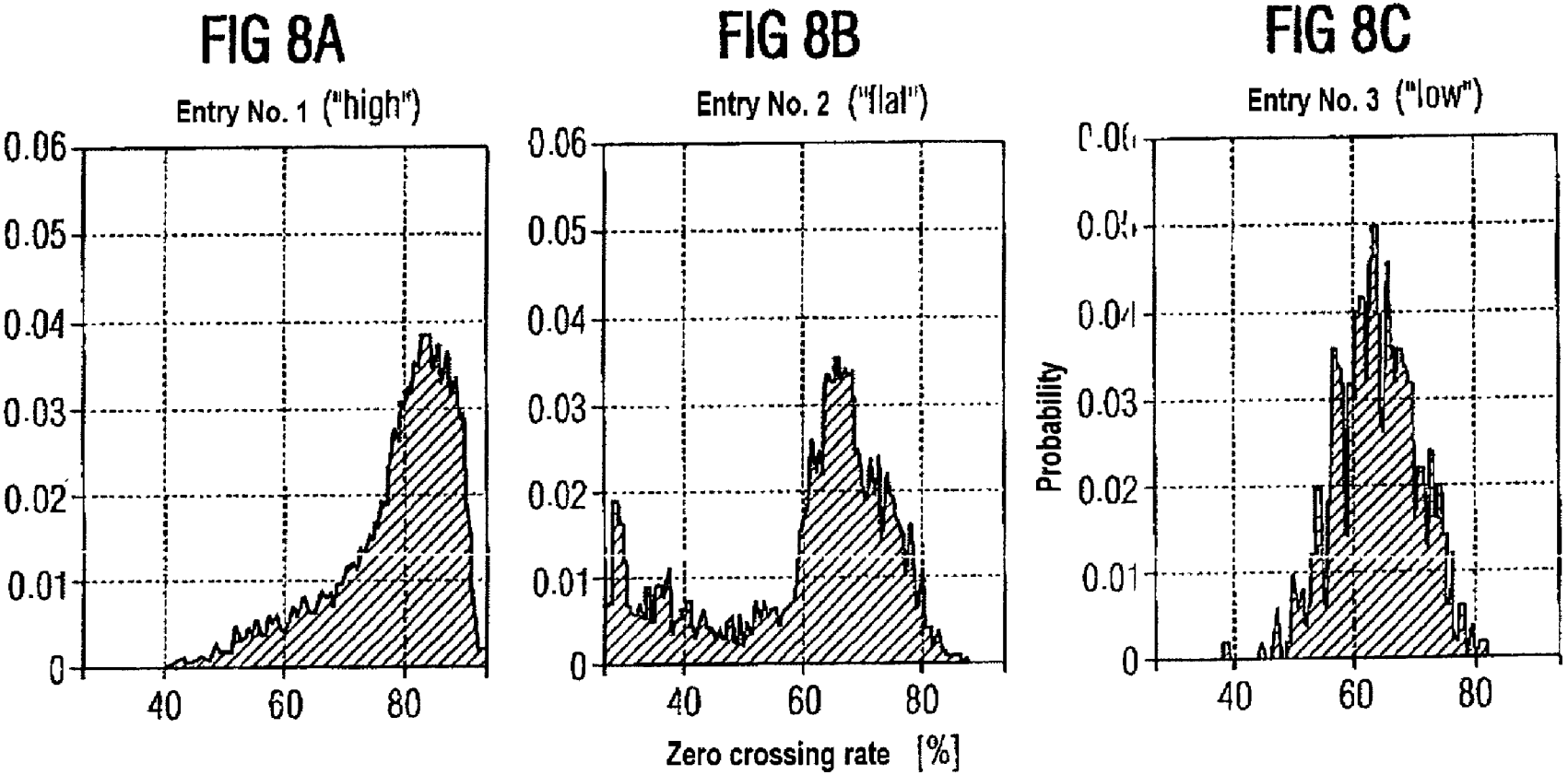
FIG. 8 shows one-dimensional histograms of the zero crossing rate.

FIG. 8 shows the one-dimensional histograms for the zero crossing rates which can be used, on their own, to explain a number of characteristics of the source.

It can be seen from this example that the value ranges that occur for different states can invariably overlap to a very major extent in this one-dimensional representation. This overlapping will lead to uncertainties and incorrect decisions during the subsequent classification process.

It can also be seen that the distribution density functions generally do not correspond to a known form, for example to the Gaussian or Poisson distribution.

Such simple models are thus obviously unsuitable if one wishes to change from the representation in the form of a histogram to modeling of the VDF.

In order to make it possible to take account of the correlations that exist between the speech parameters contained in the feature vector, a simple model must be produced to represent the N-dimensional distribution density function. It has already been mentioned that the VDF generally does not correspond to one of the known "standard forms", even in the one-dimensional case. For this reason, the modeling was carried out using so-called Gaussian Mixture Models (GMM).

In this method, a distribution density function $p(X|S_i)$ is approximated by a sum of weighted multidimensional Gaussian distributions:

$$p(X \mid S_i) \approx \sum_{l=1}^{L} P_{il} N\left(X; \mu_{il}, \sum_{il}\right)$$

The function $N(X; \mu_{il}, \Sigma_n)$ used in this expression is the N-dimensional Gaussian function $$N\left(X; \mu_{il}, \sum_{il}\right) = \frac{1}{(2\pi)^{\frac{N}{2}} \left|\sum_{il}\right|^{\frac{1}{2}}} \exp\left(-\frac{1}{2}(X-\mu_{il})^T \sum_{il}^{-1} (X-\mu_{il})\right)$$

The L scalar weighting factors $P_{il}$ as well as L parameter sets for definition of the individual Gaussian functions, in each case comprising an N×N covariance matrix $\Sigma_{il}$ and the mean value vector $\mu_{il}$ of length N=20, are thus now sufficient to describe the model for one state. The totality of the parameters of the model for a single state are referred to by $\Theta_i$ in the following text; the parameters of all the states are combined in $\Theta$.

In theory, any real distribution density function can now be approximated with any desired accuracy by varying the number L of Gaussian distributions contained in a model.

However, in practice, even quite small values of L are generally sufficient, for example in the range around 5 to 10, for sufficiently accurate modeling.

The training of the Gaussian Mixture Model is carried out following production of the code books on the basis of the same training data and the "optimum frame association" $i_{opt}(m)$ using the iterative Estimate Maximize (EM) algorithm (see, for example, S. V. Vaseghi, "Advanced Signal Processing and Digital Noise Reduction", Wiley, Teubner, 1996).

Figure 9:
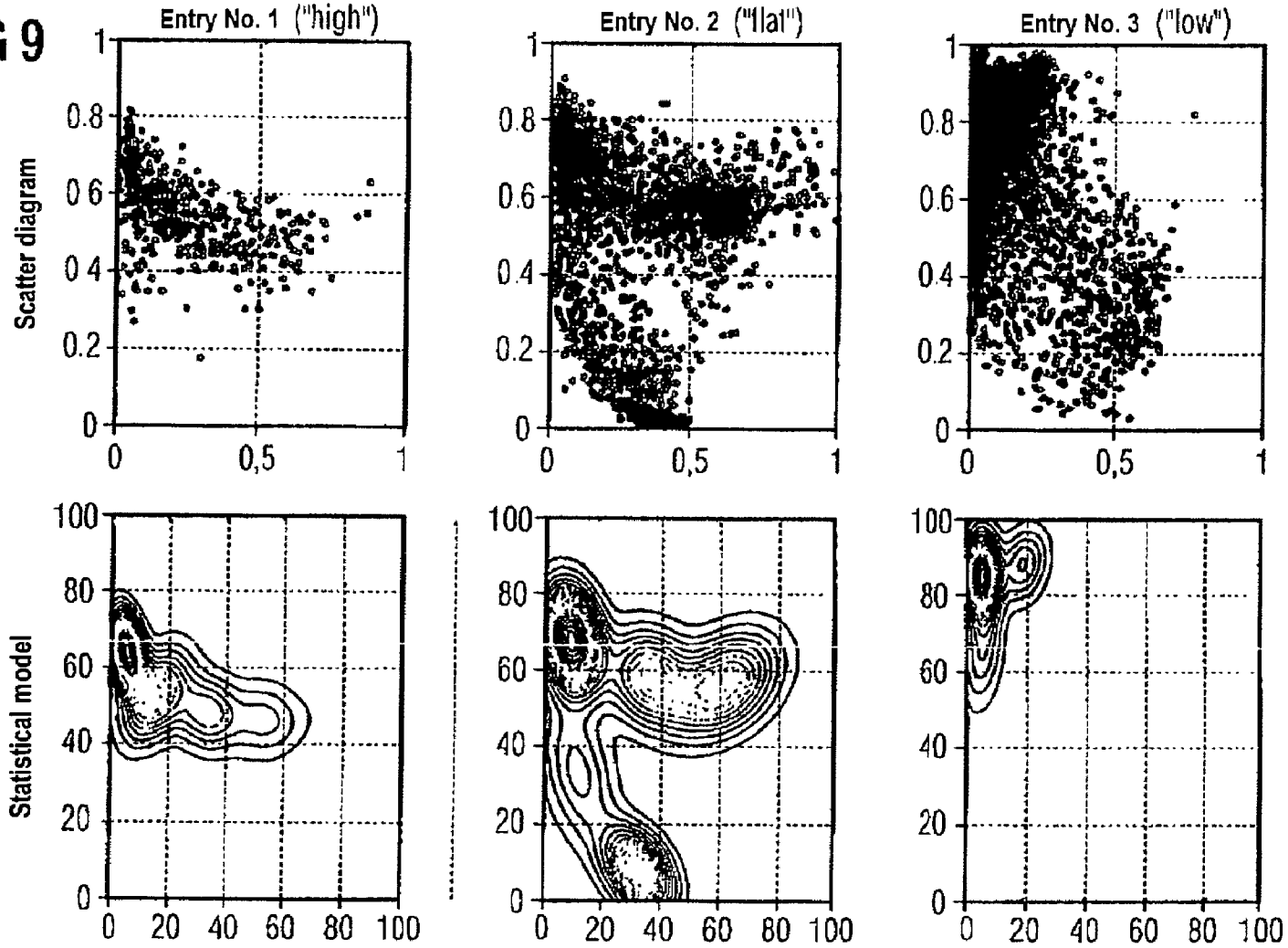
FIG. 9 shows two-dimensional scatter diagrams, together with the distribution density functions VDF modeled by the GMM.

FIG. 9 shows an example of two-dimensional modeling of a VDF. As can be seen, the consideration of the covariances allows better classification since the three functions physically overlap to a lesser extent in the two-dimensional case than the two one-dimensional projections on one of the two axes. It can furthermore be seen that the model simulates the actually measured frequency distribution of the feature values relatively well.

The probability $P(S_i)$ of the signal source being in a state $S_l$ at all is referred to as the state probability in the following text. When calculating the state probabilities, no ancillary information is considered whatsoever but, instead, the ratio of the number $M_i$ of the frames associated with a specific code book entry by means of an "optimum" search to the total number of frames M is determined, on the basis of all the training material, as:

$$\hat{P}(S_i) = \frac{M_i}{M}$$

This simple approach allows the state probabilities to be determined for all the entries in the code book, and to be stored in a one-dimensional table.

If one considers a voice signal, then it can be seen that some sounds or envelope forms occur with considerably higher probabilities than others. In a corresponding way, voiced frames occur considerably more frequently than, for example, hissing sounds or explosive sounds, simply because of the time duration of voiced sounds.

The transition probability $P(S_l^{(m)}|S_j^{(m-1)})$ describes the probability of a transition between the states from one frame to the next frame. In principle, it is possible to change from any state to any other state, so that a two-dimensional matrix with a total of $I^2$ entries is required for storing the trained transition probabilities. The training can be carried out in a similar way to that for the state probabilities by calculating the ratios of the numbers of specific transitions to the total number of all transitions.

If one considers the matrix of transition probabilities, then it is evident that the greatest maxima lie on the main diagonal, that is to say the source generally remains in the same state for more than one frame length. If the envelope forms of two code book entries between which a high transition probability has been measured are compared, then, in general, they will be relatively similar.

Now, in a final step, the current frame can be classified from the probabilities determined on the basis of the features or which a priori have been associated with one of the source states represented in the code book; the result is thus then a single defined index i for that code book entry which corresponds most closely to the current speech frame or source state on the basis of the statistical model.

Alternatively, the calculated probability values can be used for estimating the best mixture, based on a defined error measure, of a number of code book entries.

The result of the various methods depends principally on the respective criterion to be optimized. The following methods have been investigated:

The maximum likelihood (ML) method selects that state or entry in the code book for which the observation probability is a maximum:

$$\hat{S}_{ML} = \underset{i=1}{\overset{I}{\operatorname{argmax}}} P(X \mid S_i)$$

Another approach is to assume that state which is the most probable on the basis of the current observation, that is to say the a posteriori probability P(Si|X) is to be maximized:

$$\hat{S}_{MAP} = \underset{i=1}{\overset{I}{\operatorname{argmax}}} P(S_i \mid X)$$

Bayes' rule allows this expression to be converted such that only known and/or measurable variables now occur with the observation probability $P(X|S_i)$ and the a priori probability $P(S_i)$:

$$\hat{S}_{MAP} = \underset{i=1}{\overset{I}{\operatorname{argmax}}} P(S_i)P(X \mid S_i)$$

Based on the a posteriori probability that is used, this classification method is referred to as Maximum A Posteriori (MAP).

The MMSE method is based on minimizing the mean square error (Minimum Mean Squared Error) between the estimated signal and the original signal. This method results in an estimate which is obtained from the sum of the code book entries $C_i$ weighted with the a posteriori probability $P(S_l|X)$ $$\hat{C}_{MMSE} = \sum_{i=1}^{I} P(S_i \mid X)C_i = \sum_{i=1}^{I} \frac{P(S_i)P(X \mid S_i)}{P(X)} C_i$$

The probability of occurrence of the feature vector X can be calculated from the statistical model:

$$P(X) = \sum_{i=1}^{I} P(S_i)P(X \mid S_i)$$

In contrast to the two previous classification methods, the result is now no longer linked to one of the code book entries. In situations in which the a posteriori probability for one state is dominant, that is to say the decision from the method is effectively reliable, the result of the estimate corresponds to the result from the MAP estimator.

The transition probabilities can be taken into account in addition to the a priori known state probabilities for the two methods of MAP classification and MMSE estimation, in which the a posteriori probability $P(S_l|X)$ is evaluated. For this purpose, the term $P(S_l|X)$ for the a posteriori probability in the two expressions ??? must be replaced by the expression $P(S_i^{(m)}, X^{(0)}, X^{(1)}, \ldots, X^{(m)})$, which depends on all the frames observed in the past. The calculation of this overall probability can be carried out recursively.

$$P(S_i^{(m)}, X^{(0)}, \ldots, X^{(m)}) = P(X^{(m)} \mid S_i)\sum_{j=1}^{I} P(S_i^{(m)} \mid S_j^{(m-1)})P(S_j^{(m-1)}, X^{(0)}, \ldots, X^{(m-1)})$$

The initial solution for the first frame can be calculated as follows:

$$P(S_i^{(0)}, X^{(0)}) = P(S_i)P(X^{(0)}|S_i)$$

Although the invention has been explained above on the basis of preferred exemplary embodiments, it is not restricted to these exemplary embodiments but can be modified in a large number of ways.

In particular, the invention can be used for any type of voice signals, and is not restricted to telephone voice signals.

| List of Reference Symbols | |
|---|---|
| $x_{wb}$ (k') | Stimulus signal for the vocal tract, broadband |
| $s_{wb}$ (k') | Voice signal, broadband |
| $s_{nb}$ (k') | Voice signal, narrowband Sampling rate $f_a$, = 16 kHz |
| $s_{nb}$ (k) | Voice signal, narrowband |
| Θ | |
| A (z') | Transmission function of the filter that is in the inverse of the vocal tract filter |
| $H_{US}$ (z') | Transmission function of the model of the transmission path |
| $H_{BP}$ (z') | Transmission function of the bandpass filter |
| $\hat{A}_{nb}$ (z) | Coefficient set for LPC analysis filters |
| $H_I$ (z) | Transmission function of the LPC inverse filter |
| $H_s$ (z') | Transmission function of the LPC synthesis filter |
| $H_{BS}$ (z') | Transmission function of the bandstop filter |
| $\hat{A}_{wb}$ (z') | Coefficient set for LPC synthesis filters |
| $\hat{x}_{nb}$ (k) | Estimate of the stimulus signal of the vocal tract, narrowband |
| $\hat{x}_{wb}$ (k) | Estimate of the stimulus signal of the vocal tract, broadband |
| AE | Stimulus production |
| ST | Vocal tract |
| TP | Low-pass filter |
| LPCA | LPC analysis |
| BP | Bandpass filter |
| ADD | Adder |
| LPCA | LPC analysis |
| EE | Envelope widening |
| RE | Residual signal widening |
| IF | Inverse filter |
| SF | Synthesis filter |
| BS | Bandstop filter |
| IP | Interpolation |
| I | Code book number |
| RA | Reduction in the sampling frequency |
| SCH | Switch |

The invention claimed is:

1. A method for synthetic widening of the bandwidth of voice signals, comprising the following steps:

providing a narrowband voice signal at a predetermined sampling rate;

carrying out analysis filtering on the sampled voice signal using filter coefficients which are estimated from the sampled voice signal and which result in the bandwidth of the envelope being widened;

carrying out residual signal widening on the analysis-filtered voice signal; and carrying out synthesis filtering on the residual-signal-widening voice signal in order to produce a broader band voice signal with the filter coefficients estimated from the sampled voice signal;

wherein the filter coefficients for the analysis filtering and for the synthesis filtering are determined by means of an algorithm from a code book which has been trained in advance, and wherein the algorithm for determining the filter coefficients includes:

setting up the code book using a hidden Markov model, with each code book entry having an associated state in the hidden Markov model and with a separate statistical model being trained for each state, describing predetermined features of the narrowband voice signal as a function of that state;

extracting the predetermined features from the narrowband voice signal to form a feature vector for a respective time period;

comparing the feature vector with the statistical models; and determining the filter coefficients on the basis of the comparison result.

2. The method as claimed in claim 1, wherein at least one of the following probabilities is taken into account in the comparison process:

the observation probability of the occurrence of the feature vector subject to the precondition that the source for the sampled voice signal is in the respective state;

the transition probability that the source for the sampled voice signal will change to that state from one time period to the next; and the state probability of the occurrence of the respective state.

3. The method as claimed in claim 2, wherein the code book entry for which the observation probability is a maximum is used in order to determine the filter coefficients.

4. The method as claimed in claim 2, wherein the code book entry for which the overall probability $p(X(m),S_i)$ is a maximum is used in order to determine the filter coefficients.

5. The method as claimed in claim 2, wherein a direct estimate of the spectral envelope is produced by averaging, weighted with the a posteriori probability $p(S^i|X(m))$, of all the code book entries, in order to determine the filter coefficients.

6. The method as claimed in claim 2, wherein the observation probability is represented by a Gaussian mixed model.

7. The method as claimed in claim 4, wherein the bandwidth widening is deactivated in predetermined voice sections.

8. The method as claimed in claims 4, characterized in that post-filtering is carried out on the synthesis-filtered signal.

9. The method as claimed in claim 1, wherein the sampled narrowband voice signal is in the frequency range from 300

Hz to 3.4 kHz, and the broader band voice signal is in the frequency range from 50 Hz to 7 kHz.

10. An apparatus for synthetic widening of the bandwidth of voice signals having:

an input device configured to provide a narrowband voice signal at a predetermined sampling rate;

an analysis filter configured to carry out analysis filtering on the sampled voice signal using filter coefficients which are estimated from the sampled voice signal and which result in the bandwidth of the envelope being widened;

a residual widening device configured to carry out residual signal widening on the analysis-filtered voice signal;

a synthesis filter configured to carry out synthesis filtering on the residual-signal-widening voice signal in order to produce a broader band voice signal with the filter coefficients estimated from the sampled voice signal; and an envelope widening device configured to determine the filter coefficients for the analysis filtering and for the synthesis filtering by means of an algorithm from a code book which has been trained in advance, wherein the algorithm for the envelope widening device is configured to set up the code book using a hidden Markov model, with each code book entry having an associated state in the hidden Markov model and with a separate statistical model being trained for each state, describing predetermined features of the narrowband voice signal as a function of that state;

extract the predetermined features from the narrowband voice signal to form a feature vector for a respective time period;

compare the feature vector with the statistical models; and determine the filter coefficients on the basis of the comparison result.

11. The apparatus as claimed in claim 10, wherein, during the comparison, the envelope widening device takes into account, by means of at least one of the following probabilities, the observation probability of the occurrence of the feature vector subject to the precondition that the source for the sampled voice signal is in the respective state;

the transition probability that the source for the sampled voice signal will change to that state from one time period to the next; and the state probability of the occurrence of the respective state.

12. The apparatus as claimed in claim 11, wherein the envelope widening device uses the code book entry for which the observation probability is a maximum in order to determine the filter coefficients.

13. The apparatus as claimed in claim 11, wherein the envelope widening device uses the code book entry for which the overall probability $p(X(m),S_i)$ is a maximum to determine the filter coefficients.

14. The apparatus as claimed in claim 11, wherein the envelope widening device carries out a direct estimate of the spectral envelope by averaging, weighted with the a posteriori probability $p(S_i|X(m))$, of all the code book entries in order to determine the filter coefficients.

15. The apparatus as claimed in claim 11, wherein the envelope widening device represents the observation probability by means of a Gaussian mixed model.

16. The apparatus as claimed in claim 10, wherein the envelope widening device deactivates the bandwidth widening in predetermined voice sections.

17. The apparatus as claimed in claim 10, wherein the sampled narrowband voice signal is in the frequency range from 300 Hz to 3.4 kHz, and the broader band voice signal is in the frequency range from 50 Hz to 7 kHz.

* * * * *